US007963397B2

(12) United States Patent
Seagle et al.

(10) Patent No.: US 7,963,397 B2
(45) Date of Patent: Jun. 21, 2011

(54) MODULAR, KNOCK-DOWN, LIGHT WEIGHT, THERMALLY INSULATING, TAMPER PROOF SHIPPING CONTAINER AND FIRE RETARDANT SHIPPING CONTAINER BAG

(76) Inventors: Vance L. Seagle, Henderson, NV (US); Philip J. Tschirn, One Tree Hill (AU); Rick D. Imbrecht, Las Vegas, NV (US); David G. Thompson, Las Vegas, NV (US)

( * ) Notice: Subject to any disclaimer, the term of this patent is extended or adjusted under 35 U.S.C. 154(b) by 499 days.

(21) Appl. No.: 11/672,863

(22) Filed: Feb. 8, 2007

(65) Prior Publication Data

US 2007/0194019 A1 Aug. 23, 2007

Related U.S. Application Data

(60) Provisional application No. 60/771,746, filed on Feb. 9, 2006, provisional application No. 60/773,454, filed on Feb. 15, 2006, provisional application No. 60/817,868, filed on Jun. 30, 2006.

(51) Int. Cl.
*G08B 13/14* (2006.01)
*B65D 19/00* (2006.01)

(52) U.S. Cl. ..... 206/600; 340/539.13; 340/572.8; 220/4.28; 220/592.01; 220/1.5; 62/371; 62/457.1

(58) Field of Classification Search ..... 340/539.13, 340/539.11, 539.1, 531, 500, 540, 568.1, 340/572.1, 572.8, 200; 220/4.01, 4.04, 4.08, 220/4.28, 660; 342/357.06–357.15; 701/213–216
See application file for complete search history.

(56) References Cited

U.S. PATENT DOCUMENTS 3,511,191 A 5/1970 Barry
3,581,681 A 6/1971 Newton
3,654,012 A 4/1972 Schlager (Continued)

FOREIGN PATENT DOCUMENTS

CH 404185 12/1965

(Continued)

OTHER PUBLICATIONS

Kempfer, L., "Lighten the Load," Material Handling Management, pp. 26-31 (Aug. 2006).

(Continued)

*Primary Examiner* — Brian A Zimmerman
*Assistant Examiner* — Sara Samson
(74) *Attorney, Agent, or Firm* — Fliesler Meyer LLP

(57) ABSTRACT

The invention provides a knock-down, lightweight, thermally insulating, shipping container made at least in part from a polymer core covered by a thermoplastic sheet layer. In an embodiment of the invention, the shipping container is modular, being adjusted to suit the item(s) to be shipped. In an embodiment of the invention, the base, top panel and walls are made of expanded polystyrene core and combined with high impact polystyrene surface. In one embodiment, a mesh is introduced into the core to strengthen the core making the shipping container tamper proof. A shipping container bag that is light weight, strong, made of a fire retardant material and which forms an ultra violet light, weather and dust barrier can be used to store the shipping container. A system and method for supplying, dispensing, positioning, tracking, transporting, forwarding and storing the light weight shipping containers based on the shipping container bag is disclosed.

25 Claims, 22 Drawing Sheets

U.S. PATENT DOCUMENTS

| | | | | |
|---|---|---|---|---|
| 3,903,023 | A | 9/1975 | Boutillier | |
| 4,010,865 | A * | 3/1977 | Wilgus | 220/6 |
| 4,397,246 | A | 8/1983 | Ishida | |
| 4,661,302 | A | 4/1987 | Park | |
| 4,705,811 | A | 11/1987 | Park | |
| 4,734,441 | A | 3/1988 | Park | |
| 4,796,540 | A | 1/1989 | Pelfrey | |
| 5,098,498 | A | 3/1992 | Hale | |
| 5,156,094 | A | 10/1992 | Johansson | |
| 5,266,396 | A | 11/1993 | Howard | |
| 5,362,436 | A | 11/1994 | Wagner | |
| 5,369,135 | A | 11/1994 | Cambell | |
| 5,401,456 | A | 3/1995 | Alesi, Jr. | |
| 5,417,167 | A | 5/1995 | Sadr | |
| 5,525,636 | A | 6/1996 | Henn | |
| 5,544,568 | A | 8/1996 | Potgieter | |
| 5,555,980 | A | 9/1996 | Johnston | |
| 5,558,241 | A * | 9/1996 | Huffstutler et al. | 220/1.5 |
| 5,598,675 | A | 2/1997 | Pruss | |
| 5,601,912 | A | 2/1997 | Ellingson | |
| 5,685,644 | A | 11/1997 | Taylor | |
| 5,833,796 | A | 11/1998 | Matich | |
| 6,019,237 | A * | 2/2000 | Durham et al. | 220/1.6 |
| 6,021,916 | A * | 2/2000 | Stolzman | 220/675 |
| 6,029,583 | A | 2/2000 | LeTrudet | |
| 6,076,693 | A | 6/2000 | Reiter | |
| 6,123,032 | A | 9/2000 | Ohanesian | |
| 6,191,228 | B1 | 2/2001 | Nosker | |
| 6,224,706 | B1 | 5/2001 | Matich | |
| 6,294,114 | B1 | 9/2001 | Muirhead | |
| 6,380,294 | B1 | 4/2002 | Babinec | |
| 6,395,791 | B1 | 5/2002 | Chaudhary | |
| 6,431,372 | B1 | 8/2002 | Aoyama | |
| 6,446,563 | B1 | 9/2002 | Ohanesian | |
| 6,458,232 | B1 | 10/2002 | Valentinsson | |
| RE38,076 | E | 4/2003 | Brennan et al. | |
| 6,622,642 | B2 * | 9/2003 | Ohanesian | 108/57.25 |
| 6,659,020 | B1 | 12/2003 | Ball | |
| 6,745,703 | B2 | 6/2004 | Torrey | |
| 6,748,876 | B2 | 6/2004 | Preisler | |
| 6,786,992 | B2 | 9/2004 | Dummett | |
| 6,824,860 | B2 | 11/2004 | Edwards | |
| 6,941,877 | B2 | 9/2005 | Dickner | |
| 6,943,678 | B2 | 9/2005 | Muirhead | |
| 6,955,129 | B2 | 10/2005 | Moore | |
| 6,976,436 | B1 | 12/2005 | Sugihara | |
| 6,984,695 | B2 | 1/2006 | Brown | |
| 7,025,208 | B2 | 4/2006 | Baker | |
| D521,208 | S | 5/2006 | France | |
| 7,044,066 | B1 | 5/2006 | Miller | |
| 7,128,797 | B2 | 10/2006 | Dummett | |
| 7,308,857 | B2 * | 12/2007 | Moore et al. | 108/51.11 |
| 2001/0030142 | A1 * | 10/2001 | Baker et al. | 206/599 |
| 2002/0015811 | A1 | 2/2002 | Gusavage | |
| 2004/0112907 | A1 | 6/2004 | Donnelly | |
| 2005/0108988 | A1 | 5/2005 | Dickner | |
| 2005/0128086 | A1 | 6/2005 | Brown et al. | |
| 2005/0242169 | A1 * | 11/2005 | Michal, III | 235/375 |
| 2005/0263044 | A1 | 12/2005 | Bearse | |
| 2005/0274296 | A1 | 12/2005 | Dickner | |
| 2006/0003044 | A1 * | 1/2006 | DiNello et al. | 425/412 |
| 2006/0011721 | A1 * | 1/2006 | Olsen et al. | 235/385 |
| 2006/0090844 | A1 | 5/2006 | Dummett | |
| 2007/0115125 | A1 * | 5/2007 | Lyon et al. | 340/572.1 |
| 2007/0126578 | A1 * | 6/2007 | Broussard | 340/572.1 |

FOREIGN PATENT DOCUMENTS

| | | | |
|---|---|---|---|
| DE | 2045712 | | 3/1972 |
| DE | 8429708.5 | | 2/1985 |
| EP | 0 422 542 | | 6/1990 |
| EP | 0 480 451 | | 4/1992 |
| EP | 0 520 508 | | 6/1992 |
| EP | 1516823 | A | 3/2005 |
| EP | 1516823 | A1 * | 3/2005 |
| EP | 1 500 599 | | 9/2007 |
| GB | 1308036 | | 2/1973 |
| GB | 2375096 | A | 11/2002 |
| WO | WO 95/23682 | | 9/1995 |
| WO | WO 02/38471 | | 5/2002 |
| WO | WO 03/099668 | | 12/2003 |
| WO | WO 03/099676 | | 12/2003 |
| WO | WO 03/099689 | | 12/2003 |
| WO | WO 2004/026713 | | 4/2004 |
| WO | WO 2005/105590 | | 11/2005 |
| WO | WO 2005/105599 | | 11/2005 |

OTHER PUBLICATIONS

Supplemental European Search Report in connection with European Patent Application No. 07 76 3073, dated Oct. 23, 2009, received Nov. 9, 2009.

Supplemental European Search Report in connection with European Patent Application No. 07 75 7079, dated Oct. 27, 2009, received Nov. 9, 2009.

Supplemental European Search Report in connection with European Patent Application No. 07 76 3073, dated Oct. 23, 2009, received Nov. 9, 2009.

Supplemental European Search Report in connection with European Patent Application No. 07 75 7079, dated Oct. 27, 2009, received Nov. 9, 2009.

* cited by examiner

MODULAR, KNOCK-DOWN, LIGHT WEIGHT, THERMALLY INSULATING, TAMPER PROOF SHIPPING CONTAINER AND FIRE RETARDANT SHIPPING CONTAINER BAG

PRIORITY CLAIM

This application claims priority to:

(1) U.S. Provisional Patent Application Ser. No. 60/771,746, entitled: "MODULAR, KNOCK-DOWN, LIGHT WEIGHT, THERMALLY INSULATING, TAMPER PROOF SHIPPING CONTAINER", inventors: Seagle et al., filed Feb. 9, 2006;

(2) U.S. Provisional Patent Application Ser. No. 60/773,454, entitled: "LIGHT WEIGHT, STRONG, FIRE RETARDANT DUNNAGE PLATFORM BAG AND SYSTEM OF LOADING, DISPENSING AND USING BAG", inventors: Seagle et al., filed Feb. 15, 2006; and (3) U.S. Provisional Patent Application Ser. No. 60/817,868, entitled: "FREIGHT FORWARDING SYSTEM", inventors: Seagle et al., filed Jun. 30, 2006. These applications are herein expressly incorporated by reference in their entireties.

CROSS REFERENCE TO RELATED APPLICATIONS

This application is related to the following application, which was filed of even date herewith:

(4) "LIGHT WEIGHT, STRONG, FIRE RETARDANT DUNNAGE PLATFORM BAG AND SYSTEM OF LOADING, DISPENSING AND USING BAG," inventors: Seagle et al., filed Feb. 14, 2007, Ser. No. 11/675,049.

FIELD OF THE INVENTION

This invention is in the general field of light weight shipping containers that can be disassembled and re-assembled and made at least in part from material that has a polymer core covered by a thermoplastic sheet layer. A shipping container bag that is light weight, strong, made of a fire retardant material and which forms an ultra violet light, weather and dust barrier protects the integrity of the shipping containers. A system and method for supplying, dispensing, positioning, tracking, transporting, forwarding and storing light weight shipping containers based on the shipping container bag is disclosed.

BACKGROUND OF THE INVENTION

Wooden containers capable of being assembled on wooden palates can be made to suit the shipping load. The wooden container can be reinforced to suit the load, using blocking & bracing. A wooden container of standard dimension 1219 mm (48 inches)×1016 mm (40 inches)×1016 mm (40 inches) typically weighs 158-181 kg (350-400 lb). These wooden containers are neither insulated nor able to absorb appreciable shock. As a result products shipped with wooden containers are more vulnerable to damage en route. The wooden containers are also not washable and thus products shipped using wooden containers can be contaminated in situ. The wooden containers are not knock down, thereby restricting the ability to re-use the wooden container.

Other deleterious factors associated with wooden shipping containers include injuries caused by wood splinters and nails to people who handle the wooden container. Additionally, disposal of the wooden container at the end of its useful life has negative consequences for the environment.

The adoption of International Standardized Phytosanitary Monitoring (ISPM)-15 for wood packaging material (WPM) requires treatment of kiln drying of all wood in shipping containers. The United States in cooperation with Mexico and Canada began enforcement of the ISPM 15 standard on Sep. 16, 2005. The North American Plant Protection Organization (NAPPO) strategy for enhanced enforcement has been conducted in three phases. Phase 1, Sep. 16, 2005 through Jan. 31, 2006, implemented an informed Compliance via account managers and notices posted in connection with cargo that contains noncompliant WPM. Phase 2, Feb. 01, 2006 through Jul. 04, 2006, introduced rejection of violative containers and pallets through re-exportation from North America. Informed compliance via account managers and notices posted in cargo with other types of non-compliant WPM remained in force. On Jul. 05, 2006, phase 3 enforcement took effect, involving full enforcement on all articles of regulated WPM entering North America. Non-compliant Regulated WPM are not allowed to enter the United States. The adoption of ISPM-15 reflects the growing concern among nations about wood shipping products enabling the importation of wood-boring insects, including the Asian Long horned Beetle, the Asian Cerambycid Beetle, the Pine Wood Nematode, the Pine Wilt Nematode and the Anoplophora Glapripwnnis.

Thus the wooden dunnage platform has become unattractive for the international shipment of products. In addition, the wooden shipping container does not protect the shipment from accidental damage or theft as a result of accidental or intentional damage to the shipping container. The construction of wooden containers allows viewing of the products being shipped, which can allow a thief to target particular products. Any wood furring strips used to seal surfaces or cracks in wooden containers and thereby conceal the identity of the product being shipped must also meet the ISPM-15 requirements.

Food and other perishable produce being shipped can suffer from deleterious storage effects arising as a result of the uncontrolled atmosphere associated with the wooden container. Further, the wooden surface is not a sanitary surface, since it can harbor insects as well as mould and bacteria deposits.

Plastic shipping containers, constructed with plastic are known, see U.S. Pat. No. 3,915,089 to Nania, and U.S. Pat. No. 6,216,608 to Woods et al. These hard shell plastic shipping containers use no wood products and are very strong. However, they are relatively heavy (48"×40"×40" is typically 45-272 kg (100-600 lb) depending on the container type, e.g., a frame with minimal siding versus a container with structural integrity) and are expensive to manufacture. In general, because one piece molding is employed with plastic shipping containers, they cannot be 'knocked-down' or otherwise disassembled prior to return to the shipping point of origin or other appropriate destination. As a result these plastic shipping containers have a 1:1 shipping to return ratio. That is the return of the empty container requires just as much space as the original container shipment with the product.

Some shipping container manufacturers have attempted to produce a more sanitary surface by combining foam with wooden surfaces. These containers still suffer a number of disadvantages including their weight, the presence of wood requiring treatment, and their ease of entry for a thief. Further, coating the wood with foam adds the additional disadvantage that the container cannot be easily knocked down or disassembled for return to the shipping point of origin or other appropriate destination.

Thermoplastic molding is used to create a wide variety of useful articles. In general, the process of thermoplastic molding involves heating a thermoplastic material to its glass transition temperature, at which point the material become pliable, molding the pliable thermoplastic into the shape of a desired article and allowing the article to cool. Once a thermoplastic material cools to a temperature beneath the range of its glass transition temperature the material become significantly less pliable and maintains its new shape. A number of processes have been developed for shaping thermoplastics including single and twin sheet thermoforming.

Thermoplastics can be used to laminate various articles including load-bearing structures. U.S. Pat. No. 5,833,796 to Matich, which is herein incorporated by reference in its entirety, involves applying thermoplastic sheets to a preformed rigid structure. The structural component is essentially rigid and a thermoplastic skin is applied to either one or both sides of the structural component. U.S. Pat. No. 5,833,796 to Dummett, which is herein incorporated by reference in its entirety, discloses applying thermoplastic sheets to a preformed rigid structure for manufacturing dunnage platforms.

The manufacture of articles by twin sheet thermoplastic molding often involves the use of complimentary male and female molding tools. In one common methodology a thin sheet of thermoplastic material is heated until it is pliable, and positioned adjacent to a male mold. The thermoplastic sheet is then moved relative to the tool's surface until the sheet assumes the same shape as the surface of the tool. A second sheet of thermoplastic material is heated until it becomes pliable. The heated second sheet is then centered over the cavity of a female molding tool and moved relative to the female tool molding until the interior portion of the second sheet substantially conforms to the interior shape of the female tool.

Vacuum-assist molding uses a vacuum to help draw heated thermoplastic sheets into contact with the surface of the tools. Irrespective of how they are formed, after the two thermoplastic sheets have taken on the shapes of the male and female molds, the edges of the sheets are pressed together and welded to form a single article. U.S. Pat. No. 5,641,524 to Rush et al., which is hereby incorporated by reference in its entirety, discloses vacuum-assist thermoplastic molding.

An alternative to vacuum molding is plug-assist molding. In plug-assist molding, a rigid tool is used to push a heated sheet at least partly into the cavity of a second tool with a surface shape complimentary to the shape of the first tool. U.S. Pat. No. 6,379,606 to Chun et al., and U.S. Pat. No. 5,641,524 to Rush et al., both of which are hereby incorporated by reference their entirety, describe plug-assist molding. U.S. patent application Ser. No. 026,0344 to Bearse et al., which is hereby incorporated by reference in its entirety, describes using a compressible core as a plug in the plug-assist molding process. The compressible core member used becomes a part of the manufactured article and helps to strengthen and stabilize the article. The compressible member, as a part of the manufactured article, continues to resist compression. The expansive force exerted by the core member trying to expand against the constraining force exerted by the shell strengthens the bond between the shell and the core.

SUMMARY OF THE INVENTION

A knock down or collapsible shipping container made up of a plurality of surfaces including a base, four walls and a top panel each being made from a light weight core laminated with a thermoplastic. In one embodiment of the invention structural metal mesh can be inserted into the core to resist piercing of the surface. In another embodiment of the invention, the walls are held together with clasps. The shipping container is modular, lightweight, thermally insulating, tamper proof and provides a sanitary coating and thermal capacity for transportation of foodstuffs and other valuable products. Upon delivery and unloading, the walls and top of the container can be disassembled and stacked on the dunnage base to reduce the volume of the container for storage or further shipment.

In one embodiment of the invention, a shipping container bag is disclosed that is light weight, strong, made of a fire retardant material and which forms an ultra violet (UV) light reflective, weather-proof and dust particle barrier to protect the integrity of the shipping container. The expression 'UV light reflective' indicates that no more than 2% of either UV-A, UV-B or UV-C light is transmitted through the bag material. The term 'weather-proof' indicates that the bag is substantially impenetrable to water, in as much as less than 5% of 2.5 mm (1 inch) of rainfall at or below Beaufort scale 4 wind will accumulate within the bag in the form of moisture or residue at an ambient temperature of 25° C. (77° F.) and humidity of less than 80%. The shipping container bag can be used to store the shipping container, when not in use. The shipping container bag can be used to enclose the shipping container. The shipping container bag can be used to store transport and/or dispense one or more shipping containers. Alternatively, the shipping container bag can be used to store transport and/or dispense one or more knocked down shipping containers. It is understood that a person having ordinary skill in the art can tailor the dimensions of the shipping container bag to suit the number of shipping container bags to be stored and/or the configuration, knocked-down or assembled, of the containers to be stored.

In an embodiment of the invention, a system of shipping cargo using easy to disassemble shipping containers is provided to a client as a means of eliminating ISPM-15 issues, improving cargo safety, reducing shipping costs and improving convenience. The reduced weight of the easy to disassemble shipping containers compared to an equivalent wood container results in savings in freight costs. A system of pre selling the monthly production allocation of easy to disassemble shipping containers produced from a shipping container manufacturing machine to specific clients can be based on cargo lift volume contracts. Clients are selected by the 'forwarder' based on optimum profiles for cargo destinations, freight costs, type of cargo, size and importance of client and overall value of service to client, cargo manufacturer and cargo recipient. The manufacturer receives a proportion of the cost savings of shipping the cargo in return for supplying the easy to disassemble thermally insulating shipping containers for client's use in shipping client's cargo. In addition, a system and method for storing, dispensing, positioning, tracking, and transporting shipping containers based on the shipping container bag is disclosed. Such a system and method enable one or more of supplying, dispensing, positioning, tracking, transporting, forwarding and storing light weight shipping containers based on the shipping containers and the shipping container bags.

Other embodiments of the shipping container system and method for supplying, dispensing, positioning, tracking, transporting, forwarding and storing light weight shipping containers based on the shipping container bag, within the spirit and scope of the invention, can be understood by a review of the specification, the claims, and the figures.

BRIEF DESCRIPTION OF THE FIGURES

FIG. 1 displays one embodiment of the invention in which one shipping container wall of the shipping container is held in place on the edge of the shipping container base, while a second shipping container wall is brought into position;

FIG. 2 displays one embodiment of the invention in which two shipping container walls each secured to each other are secured to the shipping container base. In this configuration the two shipping container walls are stable allowing the shipping container to be loaded;

FIG. 3 displays one embodiment of the invention in which a third wall has been secured to the base and the adjacent wall, allowing loading from the top and/or remaining side to which no wall has been attached;

FIG. 4 displays one embodiment of the invention in which three walls have been secured to adjoining walls and the base. The lightweight of the shipping container (unloaded), allows tilting access for loading or unloading;

FIG. 5 displays one embodiment of the invention in which all four walls have been secured to adjoining walls and the base, where the shipping container top panel with recessed edges fits into the shipping container recessed walls;

DETAILED DESCRIPTION OF THE INVENTION

Figure 1:
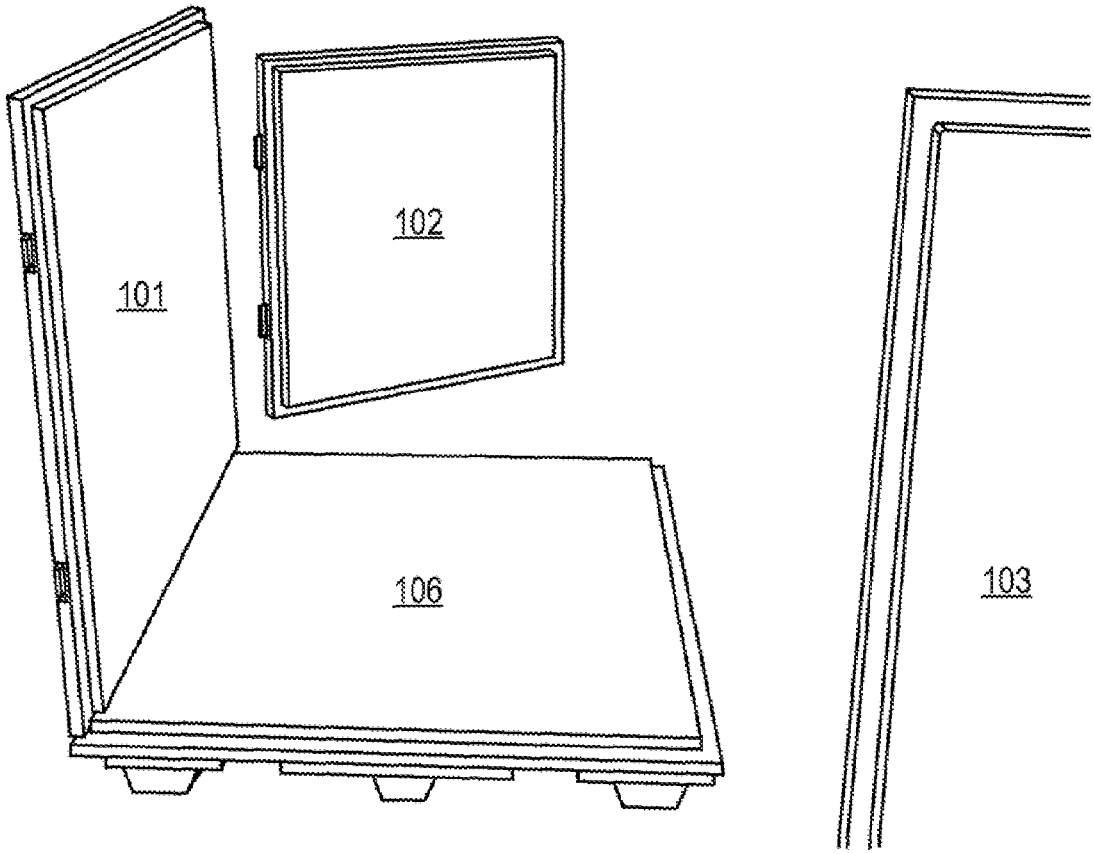
FIGS. 1-5 depict one embodiment of the invention in which the shipping container is assembled.

In one embodiment of the invention, the shipping container is a modular, knockdown, lightweight, thermally insulating, tamper proof, shipping container. In an embodiment, the shipping container dimensions are 1219 mm (48 inches)×1016 mm (40 inches)×1016 mm (40 inches). In various embodiments, the shipping container is 23 kg (50 lb) in weight. In an alternative embodiment of the invention, the core of each of the walls, top panel and base of the shipping container include a strengthening material such as wire mesh. In these embodiments, the weight of the shipping container can be 23 kg (50 lb) plus the weight of the strengthening material. In another embodiment of the invention, latches can be used when assembling the shipping container. In this embodiment the weight of the shipping container can be 23 kg (50 lb) plus the weight of the latches. In a further embodiment of the invention, the shipping container can be locked. In this embodiment the weight of the shipping container can be 23 kg (50 lb) plus the weight of the locking device. Accordingly, it is envisaged that methods of strengthening, clasping and locking the shipping container will add additional weight to the basic weight of the shipping container. In one embodiment, the clasps are over center clasps. In another embodiment the clasps are Hardy Built™ snap fasteners. Depending on the type of clasps used, different numbers of clasps can be used. For example, using Hardy Built™ clasps eight clasps can be used, where each clasp weighs approximately 1 kg (2 lb), and eight clasps will add 7 kg (16 lb) to the weight of the shipping container. In one embodiment the shipping container is 30.5 kg (67 lb) with locking clasps. However, lighter alternative clasps, straps and locks including those made of plastic or carbon fiber can add less weight and thus can be preferred.

In another embodiment the base of the shipping container differs from the standard 1219 mm (48 inches)×1016 mm (40 inches) base. In this embodiment, the shipping container base can be custom sized. The shipping container top panel can match the shipping container base and the shipping container walls can be modified based on the lesser or greater dimensions compared with the standard dimensions. The height of the shipping container can be 1016 mm (40 inches). In still another embodiment one or more of the length, width and height dimensions of the shipping container can be modified from the standard dimensions. In a further embodiment of the invention, the dimensions of the shipping container can be modified to meet the Returnable Plastic Container (RPC) requirements.

In various embodiments of the invention, the shipping container base, top panel and walls are made of a polymer core covered with a thermoplastic sheet. In various embodiments of the invention, the polymer core and thermoplastic sheet can be chemically combined. In one embodiment of the invention, the shipping container base, top panel and walls are made of an Expandable Polystyrene (PSE) core chemically combined with High Impact Polystyrene sheets (HIPS). Because of a chemical combination of components, comparing the core before the chemical combination to the shipping container material that is formed, there is an increase in strength to weight ratio of as much as 1000:1 when using PSE chemically combined with HIPS.

In various alternative embodiments of the invention, the core material can be a blend of polyphenylene ether (PPE) and polystyrene (PS) impregnated with pentane, a blend of polyphenylene ether (PPE) and polystyrene (PS) impregnated with pentane or polyethylene (PE) and Polypropylene.

In various alternative embodiments of the invention, the thermoplastic sheets used to cover the core can be either polypropylene/ polypropylene composite, Polycarbonate (PC), Low Density Polyethylene (LDPE), High Density Polyethylene (HDPE), Polypropylene (PP), Acrylonitrile Butadiene Styrene (ABS) and Polyphony Ether alloyed with High Impact Polystyrene. Many of these thermoplastic sheets have desirable properties when the shipping container design requires a living hinge or other flexible properties.

In one embodiment, a compressible core member is introduced and sandwiched between a first heated thermoplastic sheet. Subsequently, the reverse side of the core member is sandwiched between a second heated thermoplastic sheet. The join between the two thermoplastic sheet surfaces can then be cut and welded to seal the outer surface of the light weight shipping container material. By welding the joint between the two thermoplastic sheets the resulting product can be sealed so as to prohibit the collection of organic matter and thereby inhibit the growth of bacteria, mold and parasites. In an alternative embodiment, the first sheet is applied to the first surface of the core and then when the second sheet is to be applied, the edge of the first sheet is heated to allow the second sheet to be applied to the second surface of the core and at the same time welded to the first sheet applied to the edges of the core.

In another embodiment, a compressible core member is stacked or sandwiched between two heated thermoplastic sheets. The sandwich is compressed and corresponding portions of the two sheets contact one another and bond together. The core member bonds to the interior surface of the thermoplastic shell as the core member tries to expand and contacts portions of the other thermoplastic sheet.

In one embodiment the latches are attached to reinforcing plates located on the corresponding interior surfaces prior to formation of the light weight shipping container material or inside surfaces after formation of the light weight shipping container material. In an alternative embodiment of the invention, the latches are mounted to the core or the strengthening mesh and are laminated by the thermoplastic layer.

In various embodiments of the invention, a lightweight mesh is embedded in the polymer core prior to application of the thermoplastic sheet to the lower and upper surfaces of the polymer core. In an embodiment of the invention, a lightweight mesh is embedded in the expanded polystyrene core prior to chemically combining with high impact polystyrene. In an alternative embodiment, a thin perforated sheet or barrier is incorporated into the polymer core. In one embodiment the mesh, perforated sheet or barrier is metallic. In another embodiment the mesh, perforated sheet or barrier is made of Kevlar. In a further embodiment the mesh, perforated sheet or barrier is made of carbon fiber. In another embodiment the mesh, perforated sheet or barrier is made of Formica. By imbedding mesh, a perforated sheet or a barrier within the core, the shipping container base, walls and top panel cannot be simply punctured or pierced with items such as knives, chisels, crowbars or other such devices (i.e., puncture proof). As such the shipping container is defined as being 'tamper-proof' meaning that the integrity of the container is not susceptible to attack by persons wielding instruments that can be concealed under items of clothing. Tamper proof is a less stringent requirement than safe. Tamper proof is designed to insure that the container cannot be broken into by an opportunistic thief. That is persons having instruments that can be concealed under items of clothing and used to break or disturb the integrity of the container. Tamper proof does not secure a container against heavy equipment, or power tools.

In an embodiment of the invention, the mesh, perforated sheet or barrier is made of a conducting material and is connected to a voltage supply such that contact with the surface of the mesh, perforated sheet or barrier will transmit an electric shock. The electric shock can be controlled by a microprocessor to deliver one or more combinations of low voltage low current or high voltage low current shocks. The microprocessor can be inserted in the core or positioned inside the shipping container and connected to the mesh, perforated sheet or barrier. The voltage supply can be inserted in the core or positioned inside the shipping container and connected to the microprocessor circuit and the mesh, perforated sheet or barrier inside the shipping container. In an alternative embodiment of the invention, a warning siren, flashing light or foul odor alarm can be activated by the microprocessor when the integrity of the shipping container is breached. The warning siren alarm can be positioned in the core or inside the shipping container and connected to the microprocessor circuit and the voltage supply. The foul odor alarm can be positioned in the core or inside the shipping container with a cavity connecting the odor reservoir to the outside of the container and a relay valve connected to the microprocessor circuit. The flashing light alarm can be inserted in the core where the light can penetrate through the thermoplastic sheet and can be connected to the microprocessor circuit and the voltage supply. In this embodiment, the mesh, perforated sheet or barrier can be light weight and electrically conducting. When the integrity of the mesh, perforated sheet or barrier is disrupted a voltage meter senses the reduced voltage being conducted and sets off the alarm. A light emitting diode or other warning can be visible on the exterior of the shipping container and can be used to alert handlers that the shipping container is wired to an alarm system. A sensor can relay a signal to the microprocessor and can be used by the client or the shipping agent to disconnect the voltage supply or otherwise disarm the alarm, prior to unloading the shipping container on arrival at the destination.

In another embodiment of the invention, the shipping container base is made of a polymer core chemically combined with a thermoplastic sheet, while the shipping container walls and top panel are made of a core in which either mesh, a perforated sheet or a barrier are imbedded prior to chemically combining the core with a thermoplastic sheet to give the finished surface. In another embodiment of the invention, one or more of the shipping container base, walls and top panel are made of a core in which either mesh, a perforated sheet or a barrier are imbedded prior to chemically combining the core with a thermoplastic sheet to give the finished surface, while the remaining materials used to construct the shipping container are made of a polymer core chemically combined with a thermoplastic sheet. In this embodiment, the reinforced materials are indistinguishable from the non-reinforced materials when subjected to visual inspection. In this way an opportunistic thief cannot be certain how difficult it can be to gain entry to any given shipping container. In various embodiments of the invention, the shipping container exterior surfaces can be imprinted with information warning about safety and or theft protection measures required when handling the shipping container.

In one embodiment of the invention, where a surface is inserted into a groove or recess in an adjoining surface (e.g., a base is inserted into the groove of a wall) then a clasp can be used to insure the integrity of the connection. In one embodiment of the invention, the clasp can connect with the mesh, sheet or barrier inserted in the core of the first surface and can pass through a hole positioned in the groove or recess area of the second surface, where the hole allows the clasp to pass through the second surface (and the mesh, sheet or barrier inserted in the core of the second surface). The clasp can then be fixed on the outside of the second surface or connect with straps encircling the shipping container.

In one embodiment of the invention, the shipping container is made up of two or more shipping container bases which enable the container to be assembled and partially loaded while sitting on a first base and then tilted onto a second base which was acting as a wall and further loaded while in this position. By replacing some of the walls with bases, it can be possible to turn the shipping container onto another wall and continue loading of the shipping container. By replacing all walls with bases, it can be possible to turn the shipping container onto any wall and continue loading of the shipping container.

In an alternative embodiment, the shipping container can be adapted to ship liquids by first installing a bag or liner inside the shipping container, where the bag or liner is filled with the liquid. The bag or liner is then sealed to retain the liquid. In an alternative embodiment, the bag or liner is attached to the shipping container walls and the shipping container top panel is used to stop the bag or liner falling below the height of the liquid in the bag or liner and thereby avoiding spilling the contents of the liquid during shipment. In an embodiment of the invention, a package can be introduced into the container to control the temperature inside the container. The package can contain dry ice, liquid nitrogen, liquid helium or other cryogenic coolants. In another embodiment of the invention, a compressor, re-circulated coolant, external heat exhaust and power supply to drive the compressor can be introduced into the container to control the temperature inside the container.

As shown in FIGS. 1-5, the shipping container is easily assembled from the shipping container base, shipping container walls and shipping container top. FIG. 1 shows the recess present on all four walls of the shipping container dunnage base, 106, to which is aligned the recess present on each of the four walls of the shipping container walls, 101, 102 and 103. As shown in FIG. 1, the recess of the shipping container walls, 101, 102 and 103, form a step, which sits on the surface of the shipping container dunnage base, 106, while the recess of the shipping container dunnage base, 106, accommodates the non-recessed extremity of the shipping container wall, 101, 102 and 103.

Figure 2:
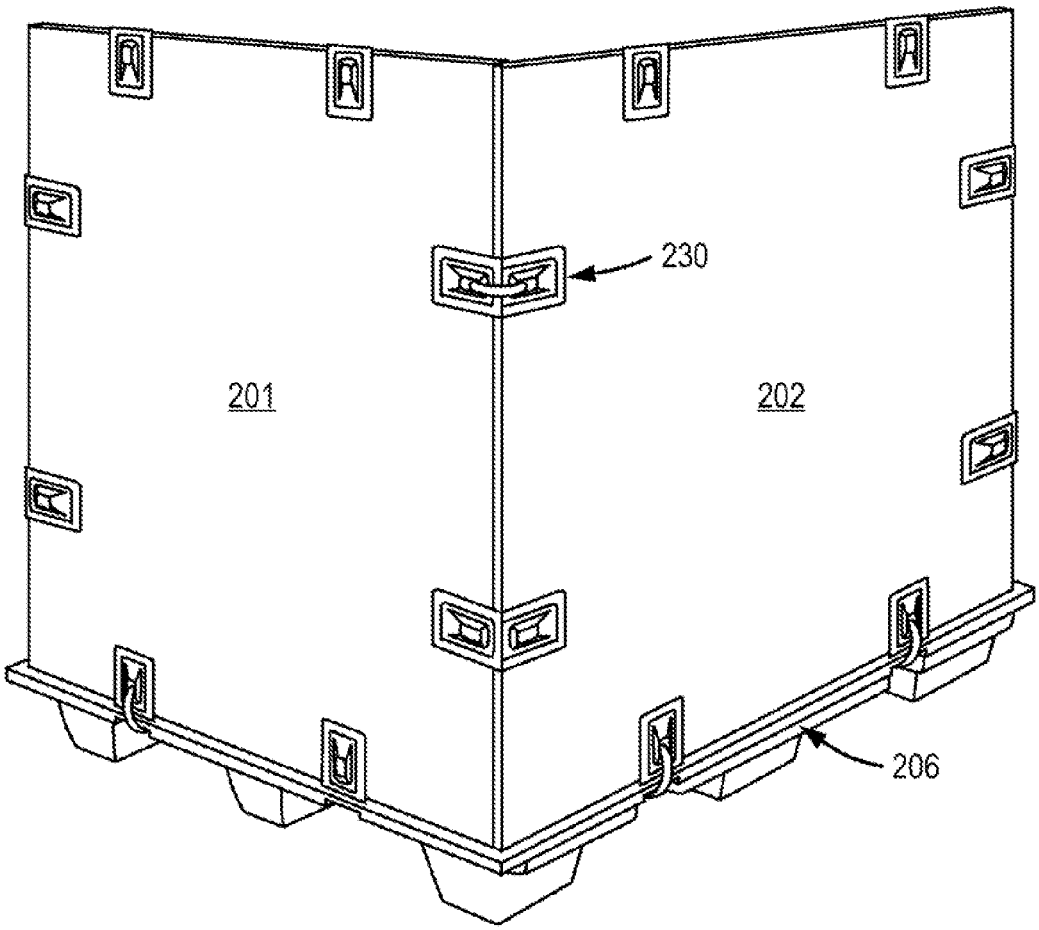

FIG. 2 shows an embodiment of the invention, in which clasps or snap-fasteners, 230, are used to hold and lock shipping container wall, 201, to shipping container wall, 202, and both shipping container walls, 201 and 202, to the shipping container dunnage base, 206. In one embodiment of the invention, the clasps, 230, are affixed to the shipping container walls with a backing plate so as to insure that the clasps, 230, cannot be pried from the shipping container walls. In various embodiments, different means to affix the clasps, 230, to the shipping container wall include rivets, screws, bolts, nuts, nails, cement and adhesives. In one embodiment of the invention, the clasps, 230, are affixed during manufacture of the shipping container walls. In an alternative embodiment of the invention, the clasps, 230, are affixed during assembly of the shipping container walls. In various embodiments of the invention, the clasps, 230, are made of metal, plastic or polypropylene.

Figure 3:
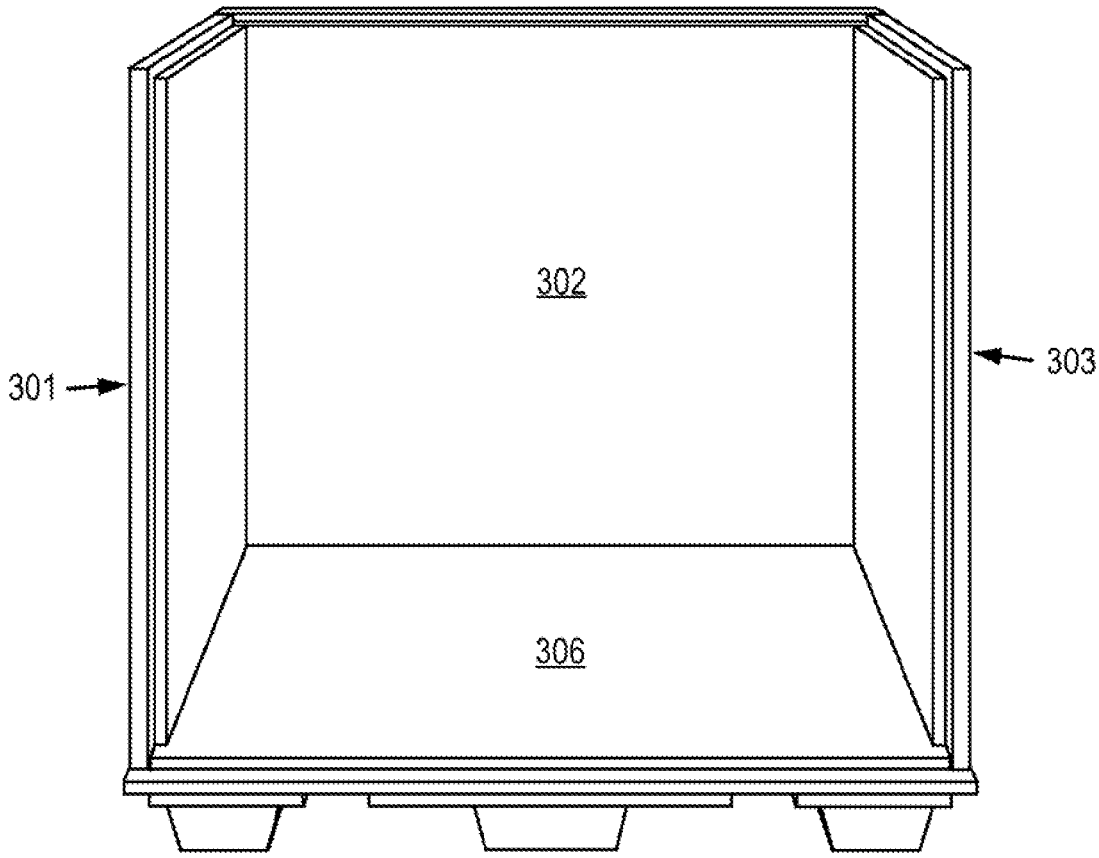
Figure 4:
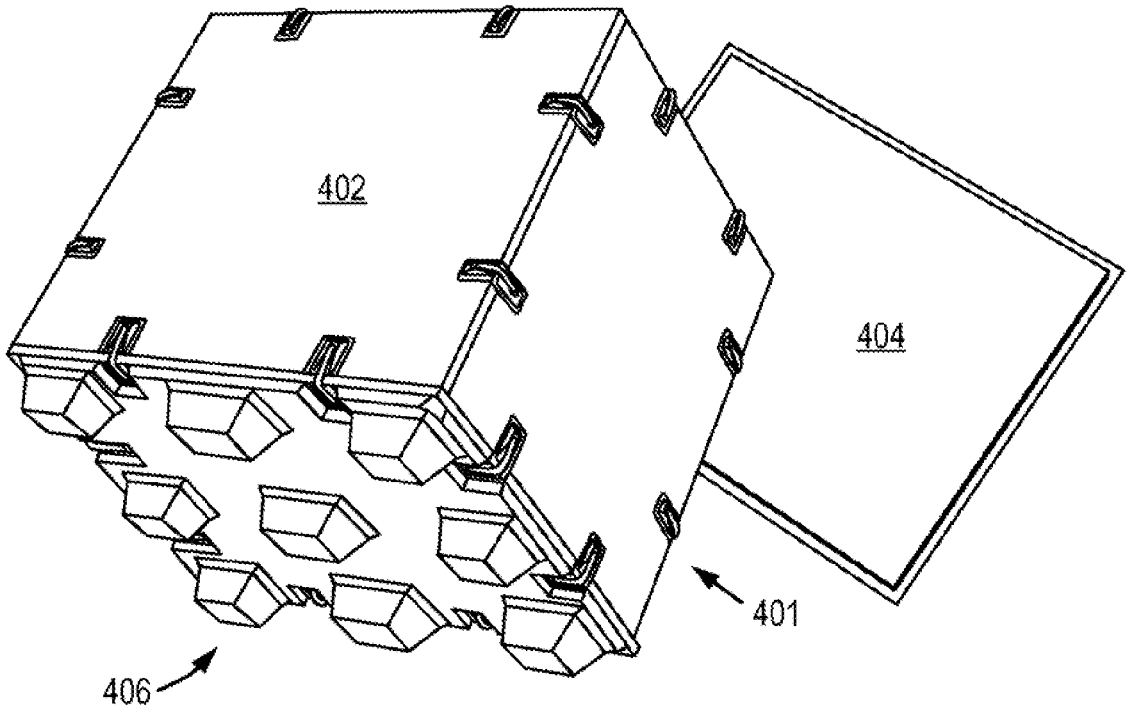
Figure 5:
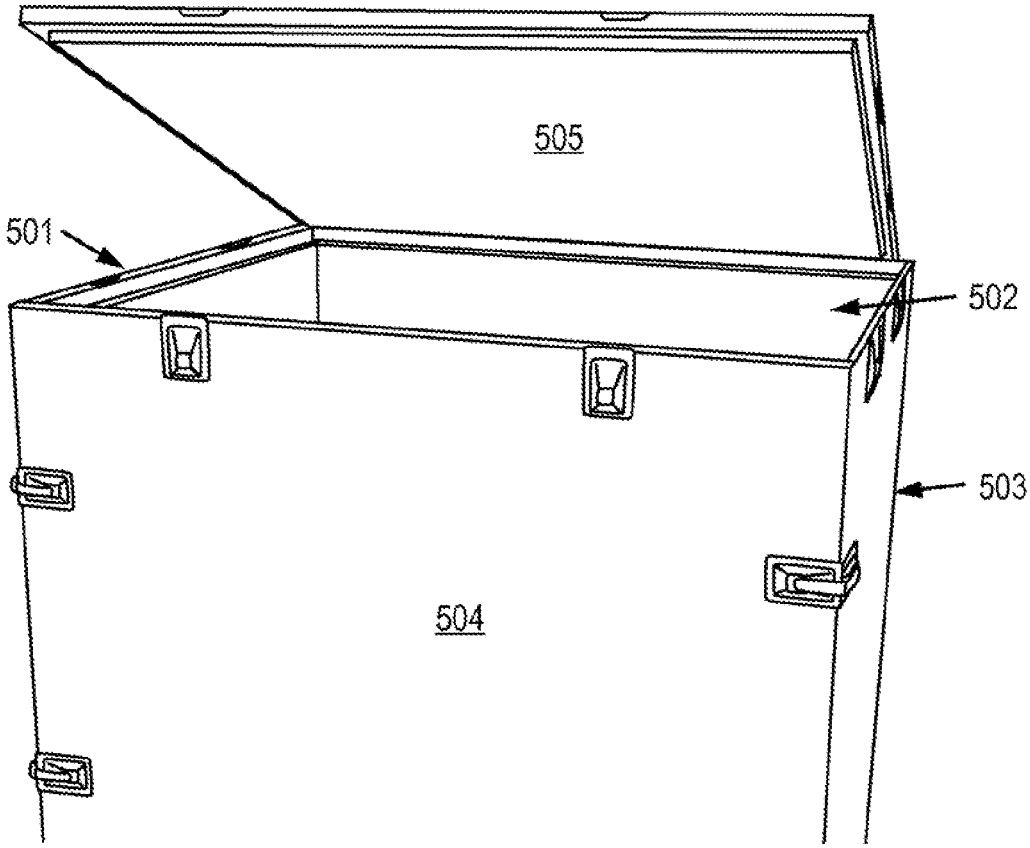

FIG. 3 shows an embodiment of the invention, in which a partially assembled shipping container in which sides, 301, 302 and 303 have been clasped together and to the base, 306, for loading of the shipment. In an embodiment of the invention, the cargo can be loaded from the side in which a wall has not been attached. In an embodiment of the invention, the cargo can be loaded from above. FIG. 4 shows an embodiment of the invention, in which a partially assembled shipping container in which sides, 401 and 402 have been latched together and latched to the base, 406, for loading of the shipment. FIG. 4 illustrates that the shipping container can be tilted to position the partially assembled light weight shipping container onto a second base, 404. The shipping container can also be tilted to reposition or to allow access for loading or unloading. FIG. 5 shows an embodiment of the invention, in which a partially assembled shipping container in which sides, 501, 502, 503 and 504, have been clasped together and the shipping container top panel, 505, which has a recess on all four sides can be lowered onto the four walls, 501, 502, 503 and 504. The recess on the top panel, 505 allows the shipping container top panel, 505, to locate into the recessed walls, 501, 502, 503 and 504. Clasps can then be used to attach the top panel, 505 to the four walls, 501, 502, 503 and 504. The recessed shipping container base, walls and top panel help the shipping container to provide a tight fit for minimizing heat transfer and added security.

Figure 6:
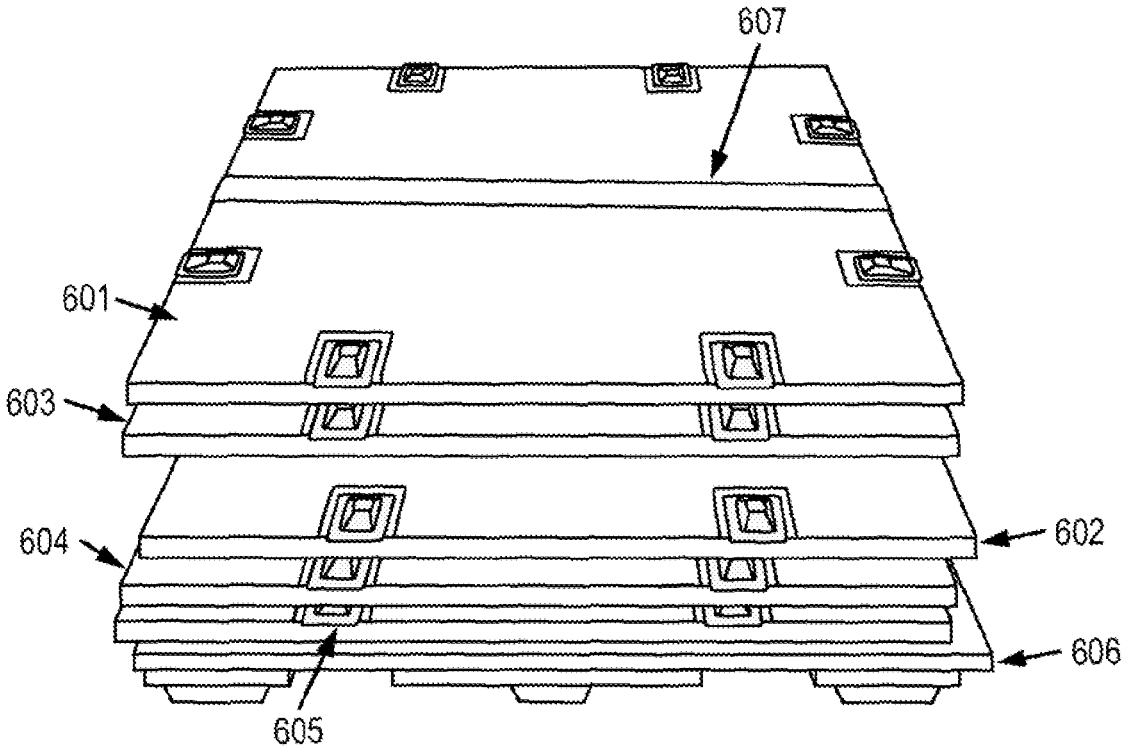
FIG. 6 displays one embodiment of the invention in which the disassembled shipping container bound together prior to insertion into a shipping container bag for return shipment.
Figure 9A:
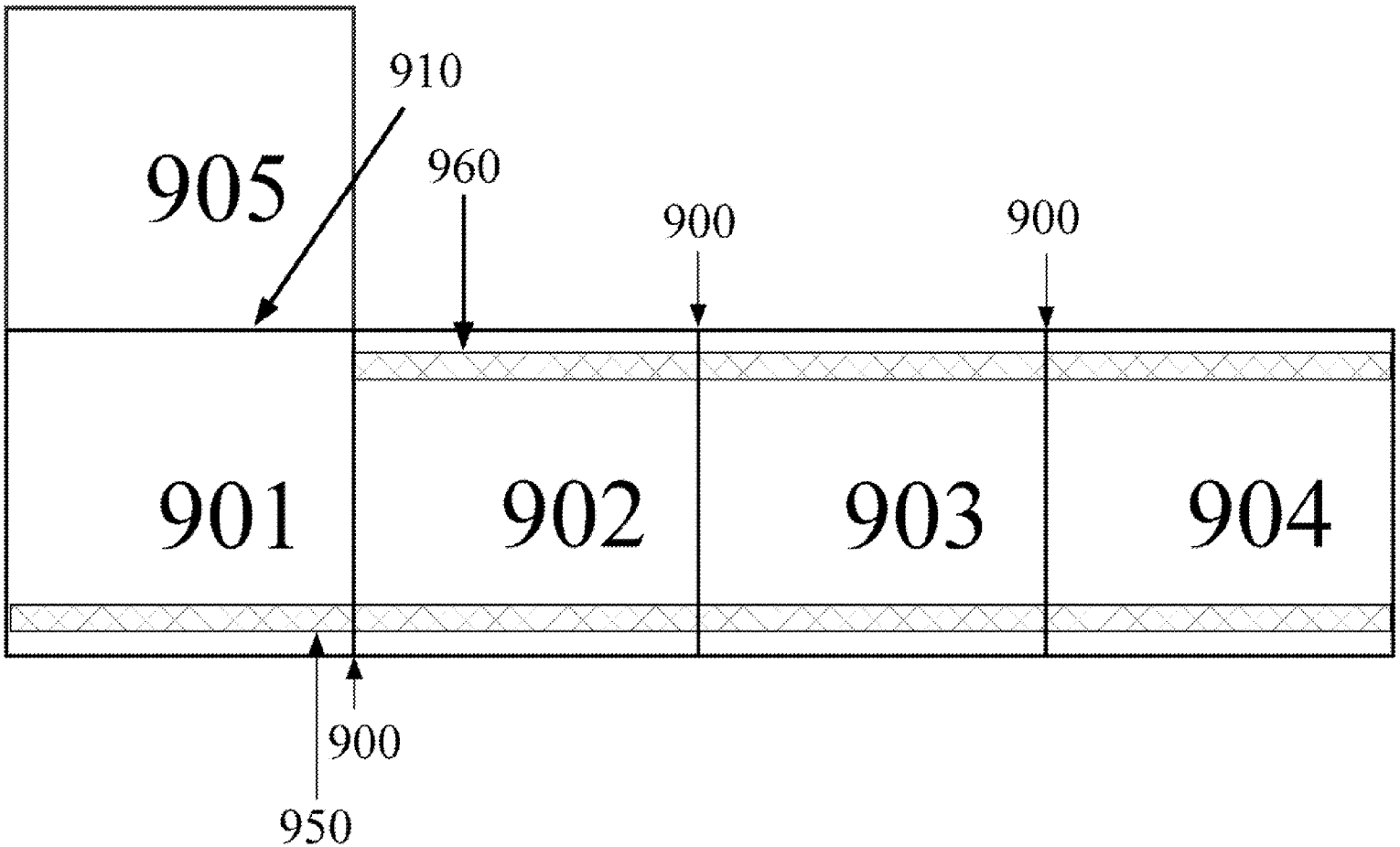
FIG. 9A displays one embodiment of the invention in which four panels of the shipping container having interconnecting living hinges, while the top panel has a 'C' type living hinge to allow the top and four walls to be assembled with fewer latches and the top panel to fit into an upper groove in the four wall panels to surround and attach the top panel and the base to fit into a lower groove in the four wall panels to surround and attach the base.
Figure 10:
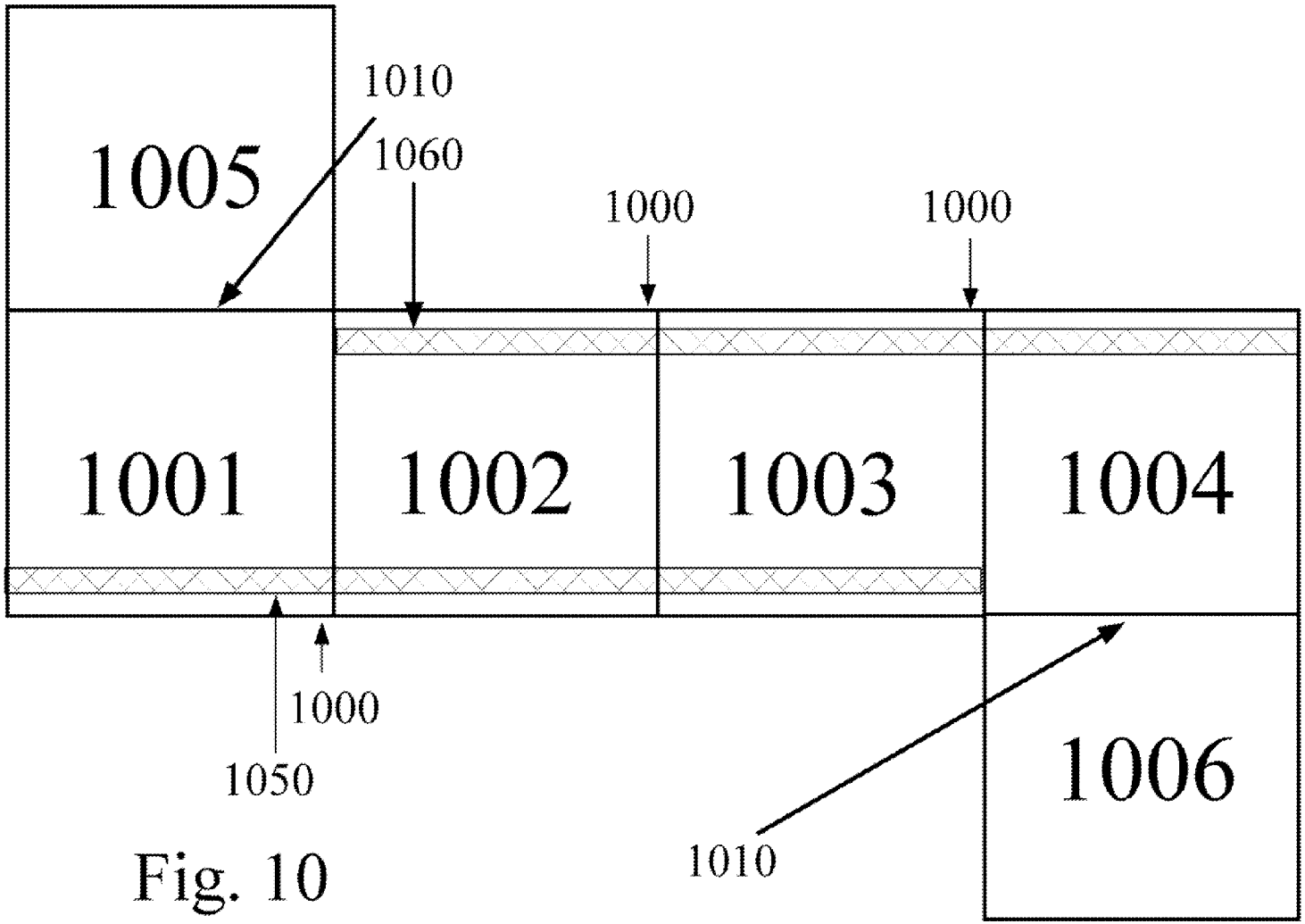
FIG. 10 displays one embodiment of the invention in which four panels of the shipping container having interconnecting living hinges, while the top panel and base have a 'C' type living hinge to allow the top panel, base and four walls to be assembled with fewer latches and the top panel to fit into an upper groove in the four wall panels to surround and attach the top panel and the base to fit into a lower groove in the four wall panels to surround and attach the base.

A major advantage of the shipping container is that it is simply and rapidly 'knocked-down' or disassembled allowing for return shipment to the point of origin or other point of destination for reassembly, reloading, re-use or storage. FIG. 6 shows the disassembled shipping container consisting of wall panels 601, 602, 603, 604 and top panel, 605, sitting on base, 606, and bound together with a tie, 607. Various embodiments of the invention are envisaged to be knock down and reassembled including those embodiments shown in FIGS. 8A, 9A and 10 which can be folded together like an accordion so that the entire shipping container lies flat as shown in FIG. 6. In an embodiment of the invention as shown in FIG. 10, wall panel 1004 folds onto base, 1006, wall panel 1003 sits on panel 1004, wall panel 1002 sits on wall panel 1003, wall panel 1001 sits on wall panel 1002 and top panel 1005 sits on wall panel 1001. The shipping container can be 'knocked-down' thereby requiring less room for storage either alone or in the shipping container storage bag. The knocked down shipping container requires less room for return shipment either alone or in the shipping container storage bag. In various embodiments of the invention, the shipping container can meet the RPC requirements. In the 'knocked-down' configuration, the ratio is 4:1, that is, 96 'knocked down' pallets will fit into a truck that can carry 24 of the assembled shipping containers.

In one embodiment of the invention, in addition to clasps, spring steel is bounded around the four shipping container walls or two shipping container walls and the shipping container base and shipping container top panel. In one embodiment of the invention, a living hinge is used with clips on one corner and the top. In one embodiment of the invention, the locking devices can be positioned on the shipping container base so that when the shipping container is standing and loaded on the ground the weight of the shipment serves to impede unauthorized access to the locks and thereby the shipment.

The combination of puncture proof walls, top panel and base together with fasteners that cannot be pried or leveraged from the puncture proof surfaces makes the shipment contained in the locked shipping container, substantially tamper-proof.

Figure 7:
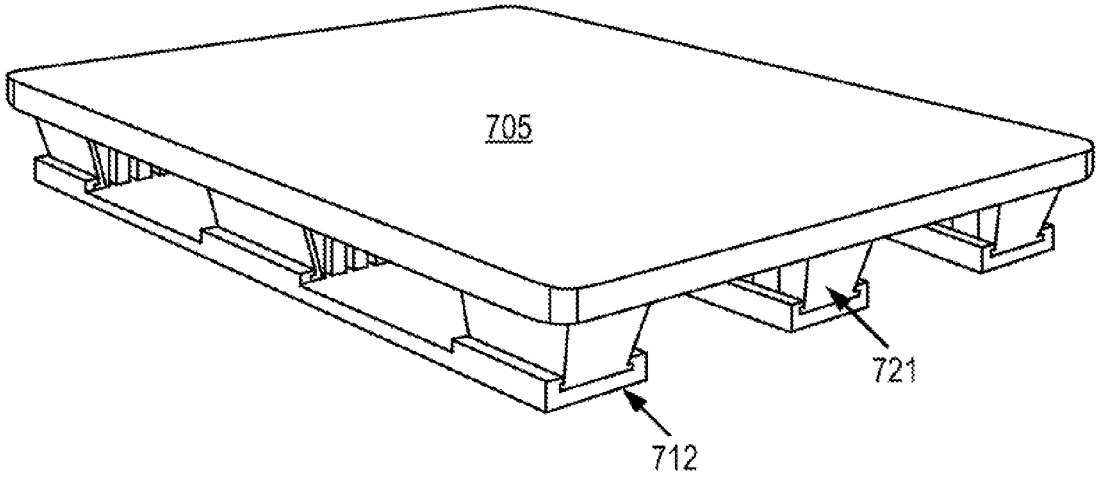
FIG. 7 displays a CAD schematic of one embodiment of the invention in which a base runner is attached to the shipping container base.

In an embodiment of the invention, the shipping container base is designed with a slight (approximately 6 mm or 0.25 inch) bulge at the bottom of each leg. As shown in FIG. 7, the bulge in each leg, 721, is adapted to receive a base runner 712, which attaches to two or more legs of the base in a lengthwise direction. The base runner, 712 is a substantially flat lower surface with inserts on the upper surface of the base runner to receive the two or more legs. In an embodiment of the invention, the base runner is made of an expanded polystyrene core chemically combined with high impact polystyrene. In an alternative embodiment of the invention, the base runner is molded from one or more thermoplastics. The lower surface of the base runner is flat to enhance stability. When the base runner is attached to the base, the shipping container sits on the upper surface of the base runner with the lower flat surface facing the ground. The base runner can be attached to the base by using a rubber mallet or other alternative means to force the base runner inserts to accept the base legs. Two or more base runners are attached to each base. Using the base runner, the shipping container can be adapted to be transported on a moving conveyor belt. In an alternative embodiment, the base and base runner are connected through a tongue and groove connection. In an alternative embodiment, the base runner is screwed, nailed, riveted, adhered, cemented or otherwise attached to the base.

Figure 8A:
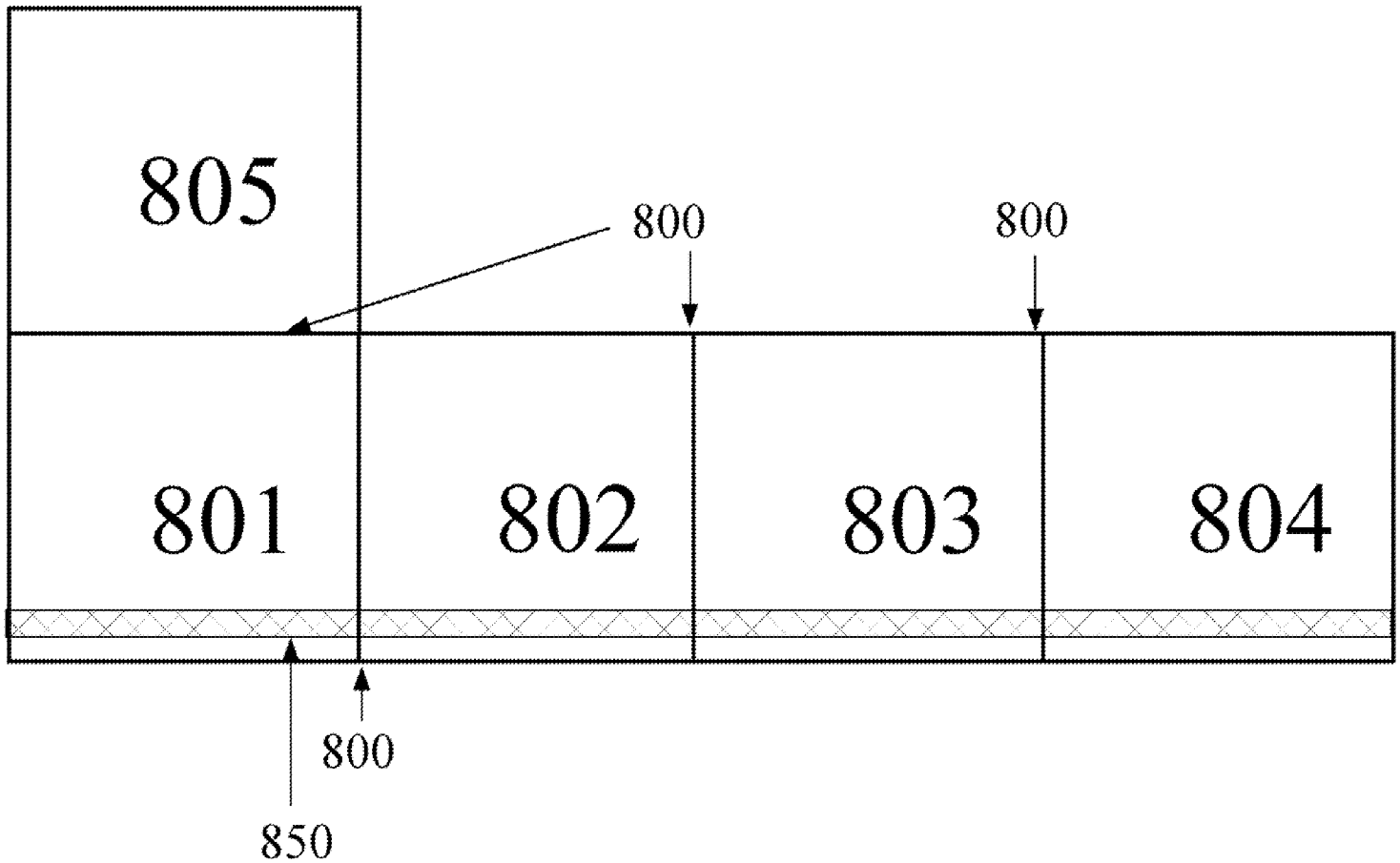
FIG. 8A displays one embodiment of the invention in which five panels of the shipping container having interconnecting living hinges to allow the top panel and four walls to be assembled with fewer latches and in which a lower groove in the four wall panels can be used to surround and attach the base.
Figure 8B:
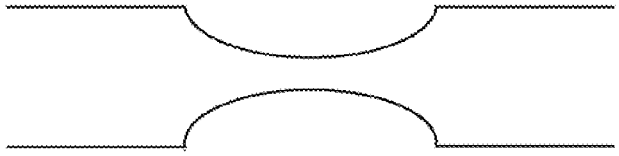
FIG. 8B displays a living hinge in accordance with one embodiment of the invention.

In another embodiment of the invention, the shipping container is constructed in two pieces with living hinges, 800 separating five panels that attach to the shipping container base. The four walls, 801, 802, 803 and 804 and the top panel, 805, are interconnected as shown in FIG. 8A or an equivalent thereof. The top panel, 805, is attached with a normal living hinge, 800 to wall panel, 801. FIG. 8B shows a cross section view of an embodiment of a normal living hinge. Wall panel 801 is also attached with a normal living hinge, 800 to wall panel 802. Wall panel 802 is also attached with a normal living hinge, 800 to wall panel 803. Wall panel 803 is also attached with a normal living hinge, 800 to wall panel 804. A groove, 850, running lengthwise over wall panels 801, 802, 803 and 804 is used to accept the surface of the shipping container base. In an embodiment, latches can be used between wall panel 801 and wall panel 804 and between the top panel, 805 and the wall panels 802, 803 and 804.

Figure 9B:
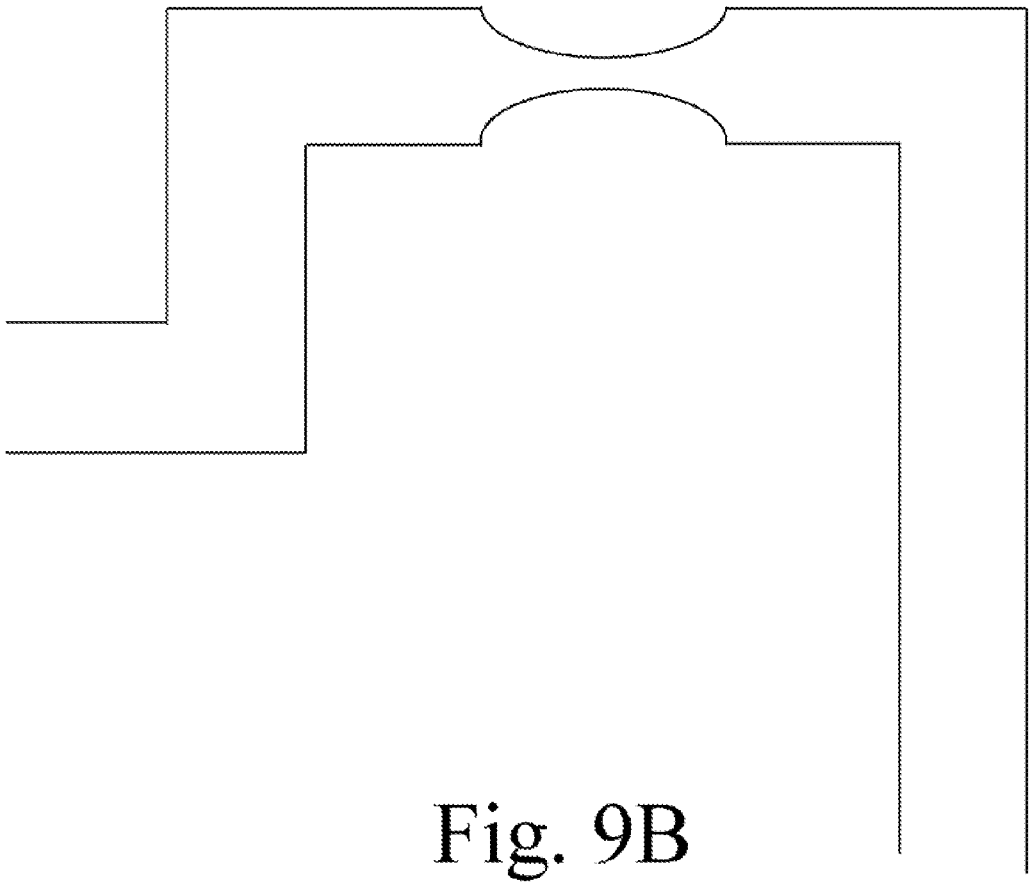
FIG. 9B displays a 'C' type living hinge in accordance with one embodiment of the invention.

In an alternative embodiment of the invention, the shipping container is constructed in two pieces with living hinges separating five panels that attach to the shipping container base. The four walls, 901, 902, 903 and 904 and the top panel, 905, are interconnected as shown in FIG. 9A or an equivalent thereof. An upper groove runs lengthwise over panels 902, 903 and 904 at the end closest to top panel 905 and a lower groove runs lengthwise over panels 901, 902, 903 and 904 at the edge furthest from top panel 905. These two grooves can be used to accept the shipping container base and top panel, 905. In an embodiment, the hinge between wall panel 901 and top panel 905 can be a 'U' section living hinge, 910, to allow the top panel, 905, to sit down in the upper groove, 960, of wall panels 902, 903 and 904. FIG. 9B shows a cross section view of an embodiment of a 'U' section living hinge. Normal living hinge, 900, connections are used between panels 901, 902, 903 and 904. In this embodiment, latches can be used between wall panel 901 and wall panel 904. The lower groove, 950, running lengthwise over wall panels 901, 902, 903 and 904 can be used to accept the surface of the shipping container base.

In another embodiment of the invention, the shipping container is constructed in one piece with living hinges separating six panels. The four walls, 1001, 1002, 1003 and 1004, the top panel, 1005 and the base, 1006, are interconnected as shown in FIG. 10 or an equivalent thereof. An upper groove runs lengthwise over panels 1002, 1003 and 1004 at the end closest to top panel 1005 and a lower groove runs lengthwise over panels 1001, 1002, 1003 and 1004 at the edge furthest from top panel 905. These two grooves can be used to accept the shipping container base, 1006, and top panel, 1005. In an embodiment, the hinge between wall panel 1001 and top panel 1005 can be a 'U' section living hinge, 1010, as shown in FIG. 9B, to allow the top panel, 1005, to sit down in the upper groove, 1060, of wall panels 1002, 1003 and 1004. A normal living hinge, 1000, connection can be used between panels 1001, 1002, 1003 and 1004. In an embodiment, latches can be used between wall panel 1001 and wall panel 1004. A lower groove, 1050, running lengthwise over wall panels 1001, 1002, 1003 and 1004 can be used to accept the surface of the shipping container base, 1006.

In an embodiment of the invention, a shipping container bag of length, 1027 mm (50 inches), width, 1067 mm (42 inches) and height, 30.5 m (120 inches) can be used to store 11 knocked down shipping containers. In another embodiment of the invention, a shipping container bag of length, 1027 mm (50 inches), width, 1067 mm (42 inches) and height, 30.5 m (120 inches) can be used to store 3 assembled shipping containers. In an alternative embodiment of the invention, a shipping container bag of length, 1027 mm (50 inches), width, 1067 mm (42 inches) and height, 60 m (240 inches) can be used to store 20 knocked down shipping containers. In another embodiment of the invention, a shipping container bag of length, 1027 mm (50 inches), width, 1067 mm (42 inches) and height, 60 m (240 inches) can be used to store 6 assembled shipping containers.

Figure 11:
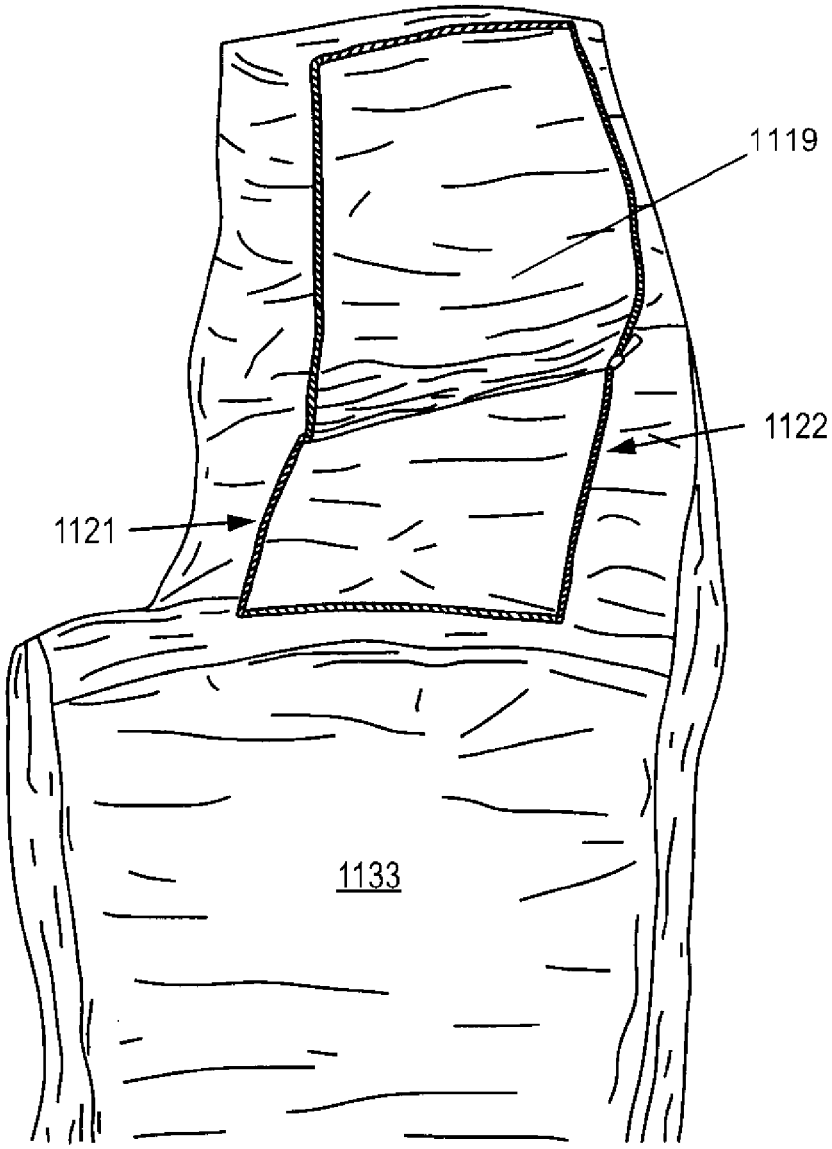
FIG. 11 displays an embodiment of the invention in which a shipping container is stored in a shipping container bag.

FIG. 11 shows an embodiment of the invention, in which a shipping container bag, 1133, is disclosed that is light weight, strong, made of a fire retardant material and which forms an ultra violet light, weather and dust particle barrier to protect the integrity of shipping containers. The shipping container bag can be used to store the shipping container. The shipping container bag can include two zippers, 1121 and 1122, to allow flap, 1119 to be lifted away from the shipping container bag, 1133 and shipping containers to be inserted, inspected or removed from the shipping container bag.

In an embodiment of the invention, the shipping container bag can be used to store one or more knocked down shipping containers. In another embodiment of the invention, the shipping container bag can be used to store shipping containers when not in use. In an alternative embodiment of the invention, the shipping container bag can be used to enclose shipping containers for storage or transportation. The shipping container bag can also be used to transport one or more knocked down shipping containers. In addition, a system and method for storing, dispensing, positioning, tracking, and transporting shipping containers based on the shipping container bag is disclosed.

Figure 12:
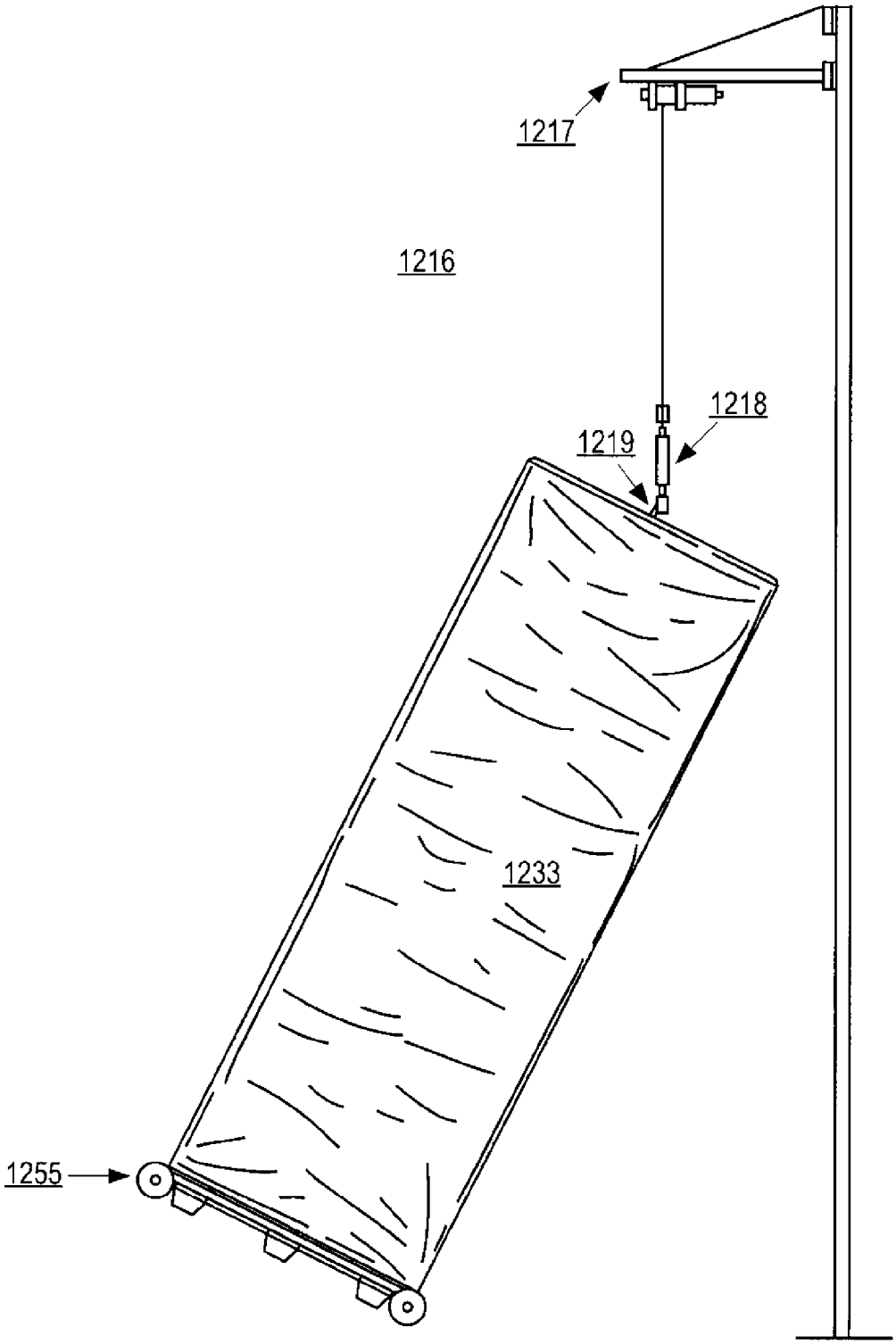
FIG. 12 shows a CAD drawing of one embodiment of the invention in which a shipping container bag can be hung to facilitate fire proof storage of empty shipping containers.

In an embodiment of the invention, a hoist can be attached to the shipping container bag via a spring attached to a hook which connects with a spreader plate to assist in storing the shipping container bag. FIG. 12 shows a CAD diagram of the shipping container bag 1233 attached to a transport base 1255 being raised with a hoist 1216 attached to a boom pipe 1217 where a spring 1218 attaches to a hook 1219 located on the shipping container bag.

Figure 13A:
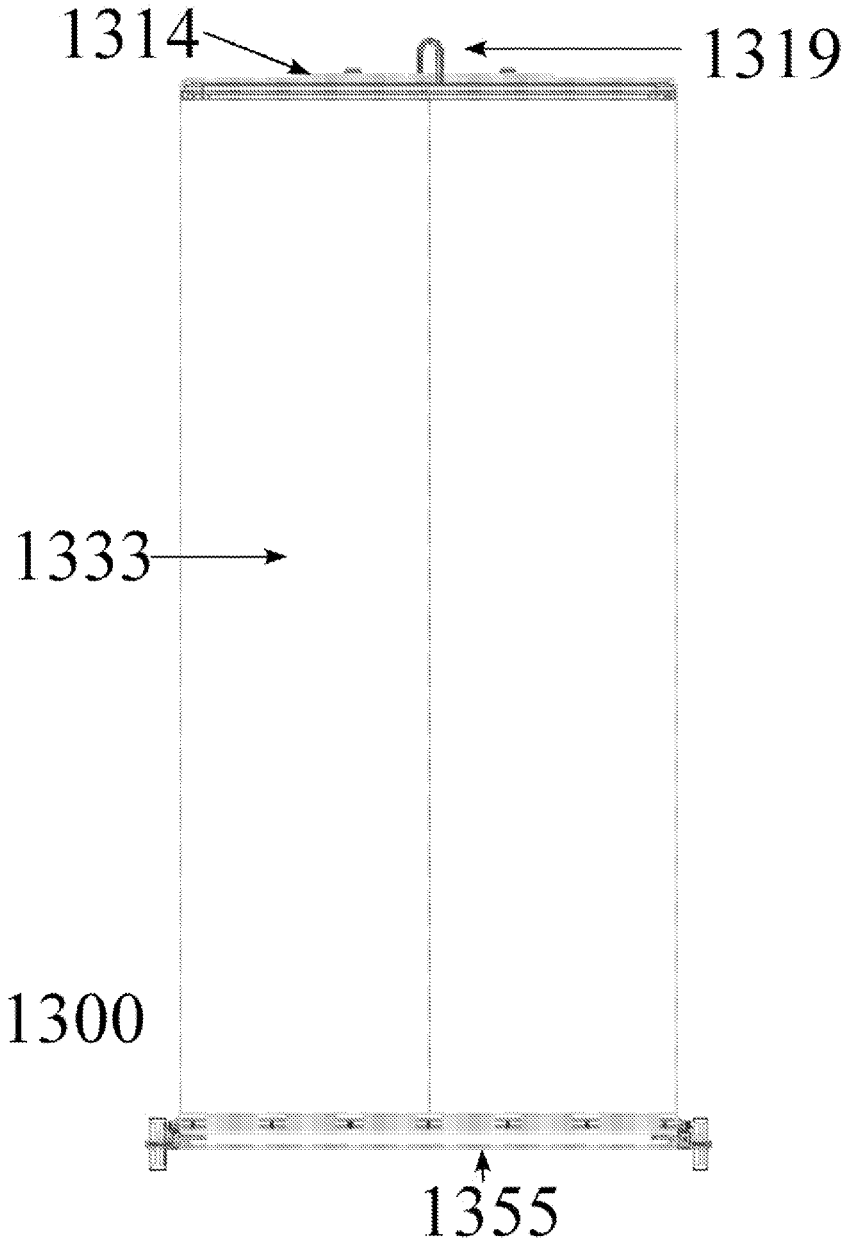
FIG. 13 (A-E) show CAD drawings of one embodiment of the invention in which an empty shipping container bag can be folded onto its dispensing base frame in different orientations.
Figure 13B:
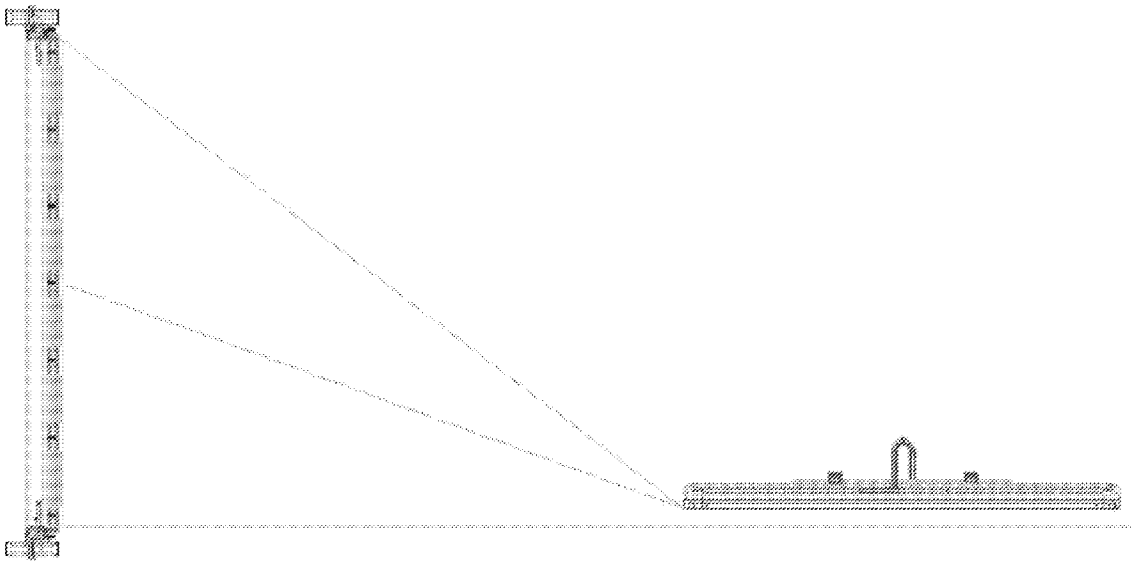
Figure 13C:
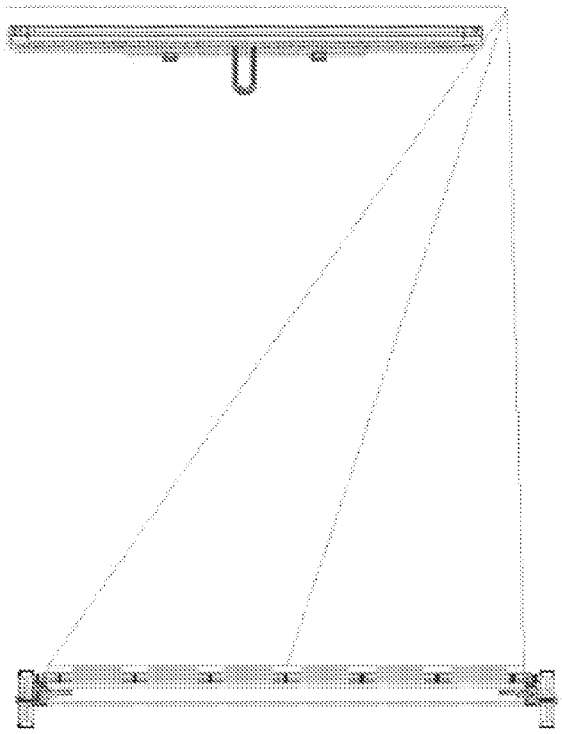
Figure 13D:
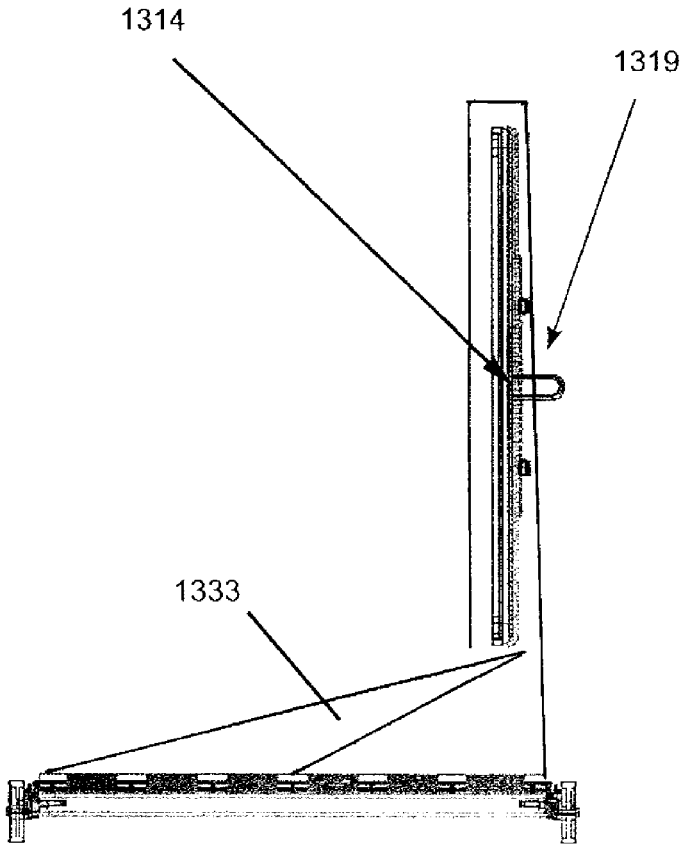
Figure 13E:
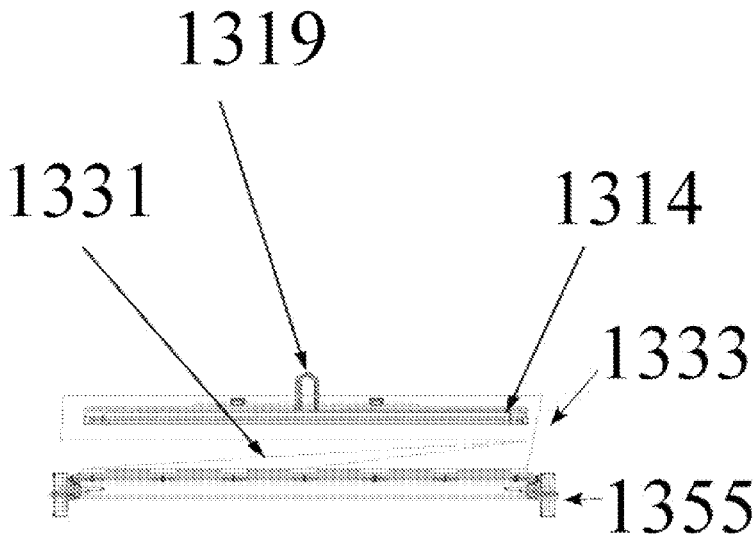

In an embodiment of the invention, a transport base can be attached to the shipping container bag to assist in moving the shipping container bag. In an embodiment of the invention, the shipping container bag can be angle folded onto itself to pack the bag for storage when not in use. FIG. 13 shows the angle bag folding method. FIG. 13A shows a CAD representation of the erect bag 1333, a hook 1319, a spreader plate 1314 and a transport base 1355. FIG. 13B shows the first fold of the erect empty bag and transport base 1300. FIG. 13C shows the next step in the folding of the erect empty bag and transport base 1300. FIG. 13D shows the second fold of the erect empty bag and transport base, where the hook 1319 which is held in place by a securing plate on the inside of the bag 1333, is placed thru a hole in the bag. FIG. 13E shows the next step in the folding of the erect empty bag and transport base 1300, where the empty bag 1333 is pulled tight, the spreader plate 1314 can be attached to the transport base frame 1355 using clips or straps and the hook 1319 is available for lifting the packed bag and transport base 1300. In an alternative embodiment of the invention, the bag is folded concertina style. In another embodiment of the invention, drawstrings are used to assist the folding of the bag.

Figure 14:
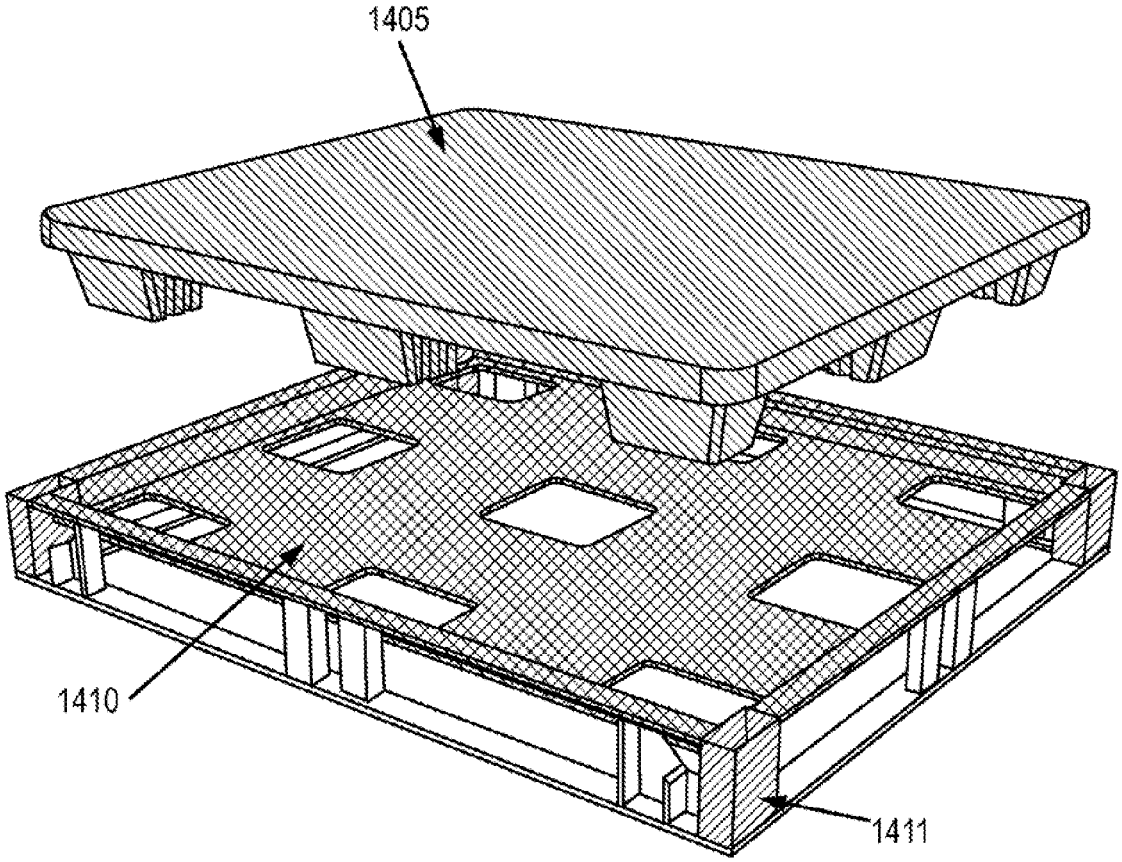
FIG. 14 displays one embodiment of the invention in which a shipping container base can be inserted into a bra system.

In an alternative embodiment of the invention, the base of the knock down collapsible shipping container is made from 0.250 inch thick aluminum plate, with dimensions 1315 mm (51.75 inches)×1035 mm (40.75 inches)×76 mm (3 inches). In another embodiment, the base, 1405, fits into an aluminum bra, 1410, as shown in FIG. 14. The bra, 1410, is constructed from aluminum plate and box section aluminum at the corners, 1411. The insert frame is 0.060 inches) thick stamped aluminum plate with holes for the pallet feet. In an embodiment, the plate inside frame is 1219 mm (48 inches)×1016 mm (40 inches) and the outside frame is 1315 mm (51.75 inches)×1035 mm (40.75 inches). In one embodiment the shipping container with aluminum base is 68 kg (150 lb) including locks. The shipping container can also be 'knocked-down' thereby requiring less room for storage either alone or in the shipping container storage bag. In the knocked down configuration, the dimensions are approximately 1315 mm (51.75 inches)×1035 mm (40.75 inches)× 380 mm (15 inches).

Figure 15:
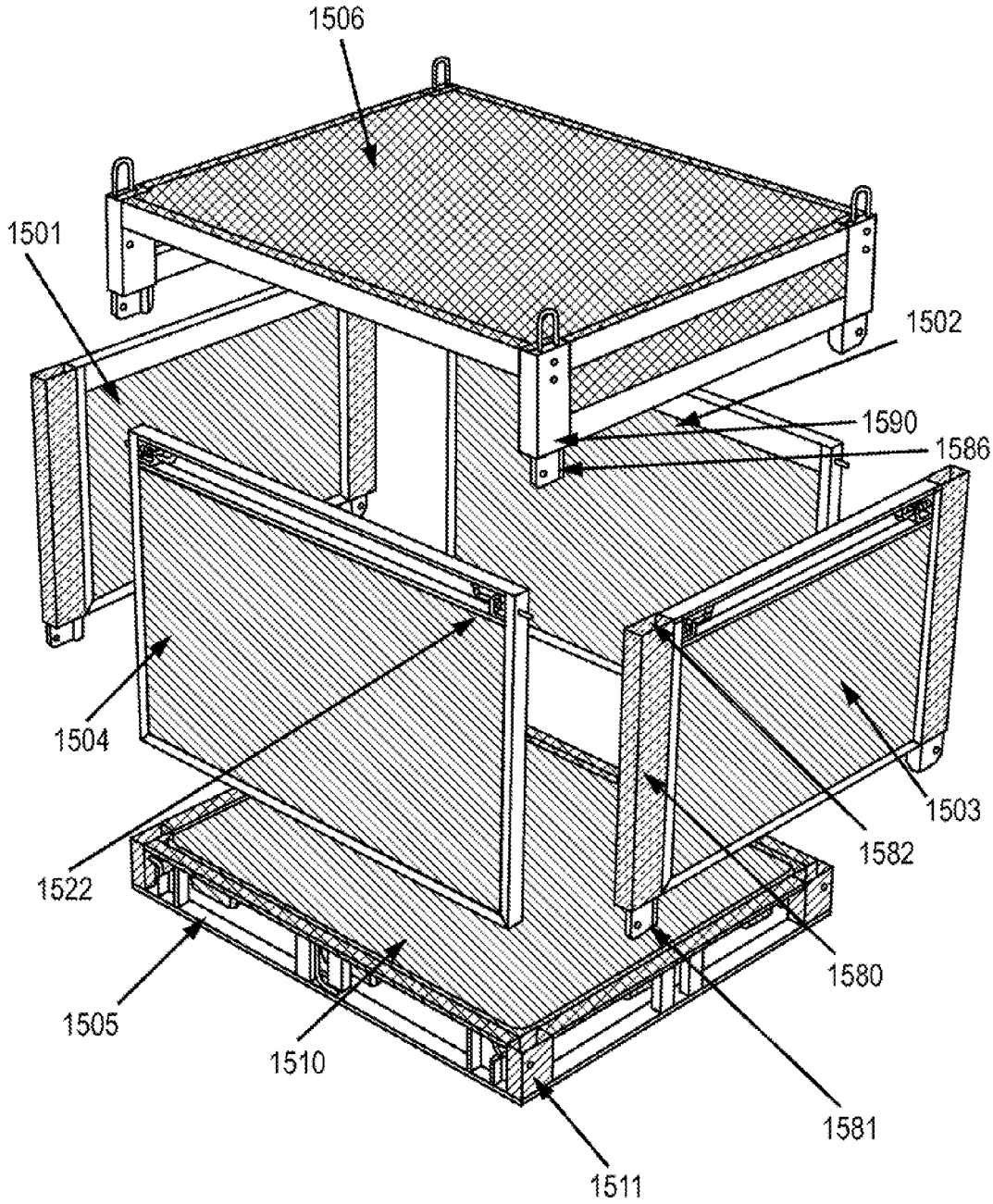
FIG. 15 displays one embodiment of the invention in which a shipping container can be disassembled from the shipping container base inserted in the bra system.
Figure 16:
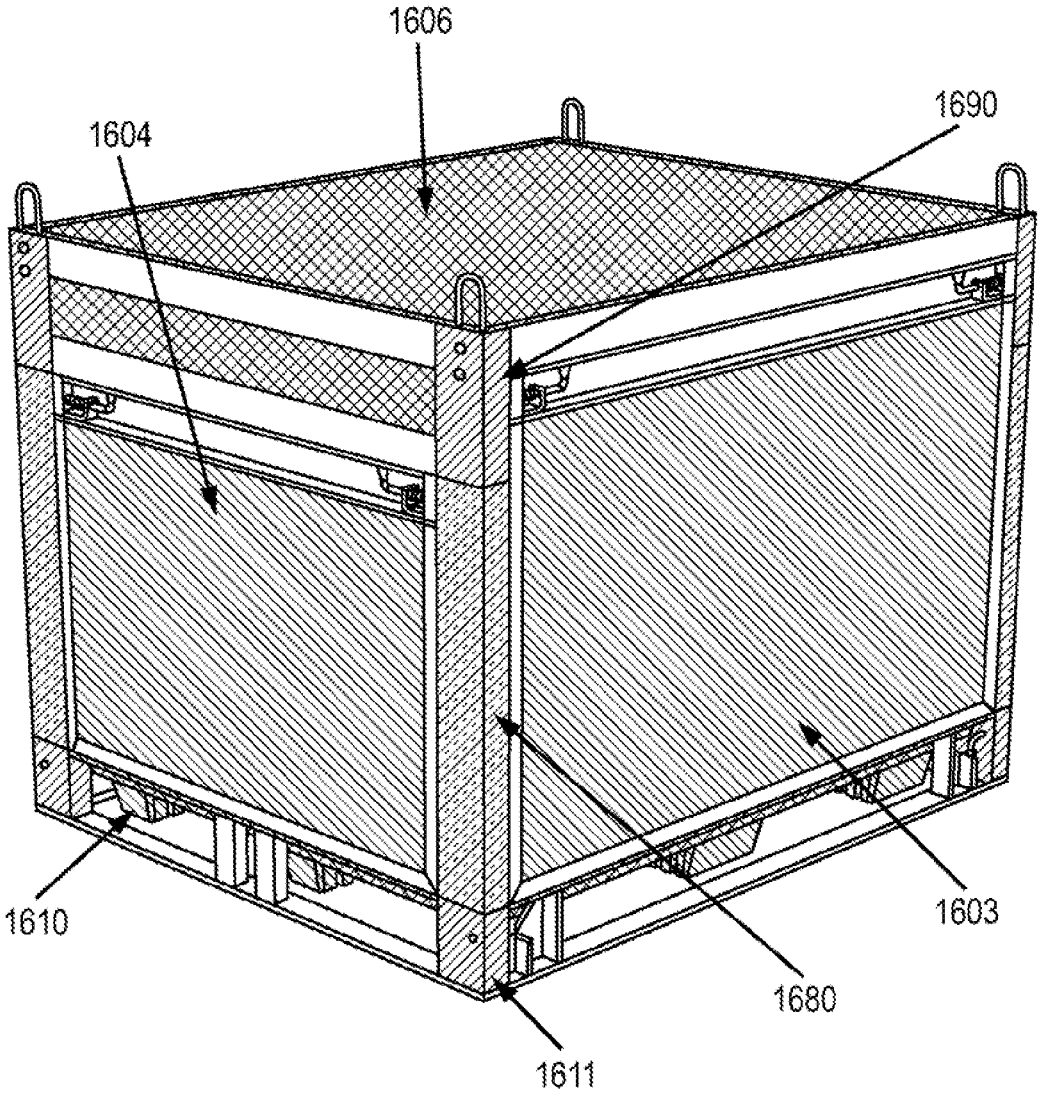
FIG. 16 displays one embodiment of the invention in which the four walls and top of the shipping container are erected around the shipping container base inserted in the bra system.

In another embodiment of the invention, the shipping container base, 1510, inserted in a bra, 1505, is connected to the walls and top panel of the shipping container. Each of the walls and the top panel fit into a square aluminum frame, as shown in FIG. 15. In this embodiment, the lightweight aluminum frame forms the corners of a cube. The frame connects with four long struts, 1580 each made of aluminum with a male end, 1581, and a female end, 1582. The four long struts, 1580 are attached to the ends of two opposite walls (1501 and 1503) and inserted into the bra, 1505, such that the male ends, 1581, of the long struts, 1580, each protrude down into the four corners, 1511, of the bra, 1505. The top panel and aluminum frame, 1506, are connected to four short struts, 1590, each made of aluminum with a male tongue, 1586, positioned at each corner of the top panel, 1506, available to be received in the female end, 1582, of the four long struts, 1580, attached to the walls, 1501, 1502, 1503, 1504 thereby attaching the top to the two walls, 1501 and 1503. The other two walls (1502 and 1504) and aluminum frame are fitted into the two empty sides and held in place by latches 1522. FIG. 16 shows an embodiment of the invention. When assembled, the corners, 1611, long struts, 1680, and short struts, 1690, form the four wall corners of the shipping container with base 1610, top panel 1606, and side walls 1603 and 1604.

In another embodiment of the invention, the shipping container base, walls and top panel are formed with a groove on each side edge rather than a recess at the end of each side. In this embodiment, the shipping container base, walls and top panel are attached to a lightweight aluminum frame. The aluminum frame is assembled in the cube shape of the shipping container. The frame has eight thin connecting aluminum struts interconnected via eight 'three point centers'. Each 'three point center' connects to three struts. Each strut that is orthogonal to two other struts connected to the 'three point center'. Each 'three point center' connects to three struts to define two sides and a top or bottom of the cube. Each strut is 'L' shaped in cross section where each side of the 'L' is a narrow knife blade. The 'L' shape of each strut is oriented so that each is pointing to define the sides of a cube. Each knife-edge is designed to fit into a groove in the side edge of each of the shipping container base, top panel and walls.

In an embodiment of the invention, a system of shipping cargo using easy to disassemble shipping containers is provided to a client as a means of eliminating ISPM-15 issues, improving cargo safety, reducing shipping costs and improving convenience.

In an embodiment of the invention, a light weight shipping container manufacturer (hereinafter 'manufacturer'), shipping forwarder (hereinafter 'forwarder') and manufacturer with cargo to ship (hereinafter 'client') co-operate to ship a client's cargo without ISPM-15 concerns at a reduced cargo freight cost, thereby producing a useful concrete and tangible result. In an embodiment of the invention, a manufacturer makes a commitment to an airfreight cargo forwarder of a cargo lift volume contract in return for supply of light weight shipping containers to resolve ISPM-15 issues and other advantages such as cargo safety, human safety and convenience. Client agrees to pay shipping freight cost as would be incurred with wood containers. In return the manufacturer makes a commitment of sufficient light weight shipping containers for shipping the cargo. The airfreight cargo forwarder who assigns manufacturing capacity to client requires a balancing commitment from the client of a cargo lift volume contract. By using a light eight shipping container the air freight forwarder saves between 68-159 kg (150-350 lb) per shipping container. Assuming the light weight container is as much as 63 kg (140 lb), the airfreight cargo forwarder saves 60% of the direct air cargo freight container cost of shipping the cargo (for a 63 kg (140 lb) light weight shipping container compared with a 160 kg (350 lb) wood container). Thus the reduced weight of the easy to disassemble shipping containers compared to an equivalent wood container results in savings in freight costs, thereby producing a useful concrete and tangible result. The airfreight cargo forwarder using light weight shipping containers which do not contain wood solves clients ISPM-15 concerns, thereby producing a useful concrete and tangible result.

In an embodiment of the present invention, the manufacturer ships the light weight shipping containers in a fire retardant bag which the client can use to hang, store and dispense the light weight shipping containers as required, saving space while eliminating a fire hazard and thereby producing a useful concrete and tangible result. In another embodiment of the present invention, the manufacturer supplies a fire retardant bag which the client can use to hang and store light weight shipping containers after unloading cargo received, saving space while eliminating a fire hazard and thereby producing a useful concrete and tangible result. In an alternative embodiment of the present invention, the manufacture supplies light weight shipping containers with RFID tags thereby allowing the forwarder to track the shipment while en route thereby producing a useful concrete and tangible result. In an alternative embodiment of the present invention, the manufacture supplies shipping container bags with RFID tags thereby allowing the forwarder to track the use requirements of the client thereby producing a useful concrete and tangible result.

In an embodiment of the invention, one or more forwarders provide light weight shipping containers and shipping container bags to their clients free of charge in exchange for retaining the financial benefit of weight savings. In an embodiment of the invention, the client receives one or more advantages including (1) improved convenience, (2) cost savings of not having to buy shipping containers, (3) eliminating ISPM-15 issues, (4) improving cargo safety (5) improving human safety, (6) the ability to track demand for shipping containers to ship cargo, (7) the ability to track receipt of shipping containers and remove unwanted unloaded shipping containers and (8) the ability to track shipping containers en route.

In an embodiment of the invention, manufacturer production facilities can be located at desirable locations to clients. Factories can be readily placed in forwarders' market regions to service local clients. In an embodiment of the invention, the facility can be moved if changes occur in the geographic location of client cargo shipping needs. These advantages are facilitated because the production facilities are: (1) remarkably portable and inexpensive, (2) easily deployed anywhere, and (3) able to produce up to 2,500 light weight shipping containers per month. In an embodiment of the invention, additional facilities can be deployed to address increases in production. Thus the production facilities can be adjusted to match the production scale.

In an embodiment of the invention, each forwarder can secure exclusive "Agency" rights for a port or market region and pre-sell the full monthly production allocation of 2,500 light weight shipping containers (per manufacturer machine) by consigning them free of charge to strategic clients in exchange for cargo lift volume contracts. In an embodiment of the invention, when the first allocation has been sold, pre-sale of a second production allocation, based on an additional manufacturing machine, can begin until the major market clients are fully sold on a first-option basis. In this way the risk of investment in manufacturing machines can be offset by cargo lift volume contracts. Clients are selected based on optimum profiles for cargo destinations, freight costs, type of cargo, size and importance of client and overall value of service the program provides to forwarder and client.

Revenues to forwarder are calculated on a cargo weight savings basis of 90 kg (200 lb) per shipping container and shipping container costs are paid to manufacturer from those savings, leaving the cash balance to the forwarder. At $1 per 0.45 kg (1 lb), each shipping container can yield $200 cash profit ($125,000 month) to the forwarder. The forwarder would have no cash risk, as manufacturer is paid ($150) per shipping container from the saving stream (following collection of client's invoices) and the remainder is held by the forwarder. The major expense of the forwarder involves sales effort to pre-sell the cargo region.

In another embodiment of the invention, a Radio Frequency IDentification (RFID) tag is imbedded in one or more of: the core of the base, the core of the top panel and the cores of the four walls. In one embodiment of the invention, the RFID tag operates using an Ultra High Frequency (UHF) signal. In another embodiment of the invention, the RFID tag operates using a microwave frequency signal.

In one embodiment, the RFID tag is centered in the middle of the core of the base, top panel or walls. In another embodiment, the RFID tag is placed on the edge of the core of the base, top panel or walls prior to the lamination of the core with the high impact polystyrene. In an embodiment where metal mesh, perforated sheet or a barrier are placed within the core, the RFID tag can be positioned so that the RFID tag antenna is least affected by the metal in the core.

In one embodiment the RFID tag is read only. In another embodiment, the RFID tag contains an Electrically Erasable Programmable Read-Only Memory (EPROM), which enables both read and write functions. In an embodiment of the invention, the RFID tag is passive. In another embodiment of the invention, the RFID tag is semi passive containing a source of energy such as a battery to allow the tag to be constantly powered. In a further embodiment of the invention, the RFID tag is active, containing an internal power source, such as a battery, which is used to power any Integrated Circuit's (ICs) in the tag and generate the outgoing signal. In another embodiment, the tag has the ability to enable location sensing through a photo sensor.

In one embodiment of the invention, a cellular modem is imbedded in the core of one or more of the base, top panel and walls of the shipping container. The cellular modem can be a Code Division Multiple Access (CDMA) modem. In an embodiment of the invention, a RFID reader and associate integrated circuit processor are embedded together with the cellular modem in the core of one or more of the base, top panel and walls of the shipping container. In such an embodiment, the RFID tags and RFID reader are positioned to optimize the RFID read of the RFID tags from the other surfaces, which make up the shipping container.

In an embodiment of the invention, where a RFID reader and a cellular modem are embedded in the core of one or more of the plurality of surfaces in the shipping container, the RFID reader is in communication with one or more of the RFID tags which make up the surfaces of one or more shipping containers in the vicinity of the RFID reader. The RFID reader and associated integrated circuit processor are able to distinguish the RFID tag from surfaces associate with different shipping containers based on one or more of location, strength of signal, variation of RFID tag signal with time and prior input data. In an embodiment of the invention, the RFID reader and associate processor are in communication with the embedded cellular modem. In an embodiment of the invention, the cellular modem is in communication with a base station and can transmit one or more parameters selected from the group consisting of one or more RFID tag location, one or more RFID tag identification code, shipment information, shipment condition, shipment container condition, time stamp.

In an embodiment of the invention, the microprocessor that monitors the integrity of the shipping container can transmit an alarm signal through the cellular modem thereby silently alerting the shipping agent to the breach of the shipping container integrity.

In one embodiment of the invention the RFID code uses the IEEE format and is Electronic Product Code (EPC) readable. In another embodiment of the invention the RFID code uses the UCC format and is Universal Product Code (UPC) readable. In another embodiment, the format is compatible for EPC, European Article Number (EAN) and UPC read and write functions.

In one embodiment of the invention, a manufacturer makes a commitment to an airfreight cargo forwarder of a cargo lift volume contract in return for supply of easy to disassemble thermally insulating shipping containers to resolve ISPM-15 issues and other advantages such as cargo safety, human safety and convenience. Client agrees to pay shipping freight cost as would be incurred with wood containers. In return the manufacturer makes a commitment of sufficient easy to disassemble thermally insulating shipping containers for shipping the cargo. The airfreight cargo forwarder who assigns manufacturing capacity to clients requires a balancing commitment from the client of a cargo lift volume contract. The airfreight cargo forwarder saves 60% of the total freight cost of shipping the cargo (after subtracting the cost of the easy to disassemble thermally insulating shipping containers), while solving clients ISPM-15 concerns.

In an embodiment of the invention, an easy to disassemble thermally insulating shipping containers manufacturer (hereinafter 'manufacturer'), shipping forwarder (hereinafter 'forwarder') and manufacturer with cargo to ship (hereinafter 'client') co-operate to ship a client's cargo without ISPM-15 concerns at a reduced cargo freight cost, thereby producing a useful concrete and tangible result. In an alternative embodiment of the present invention, the manufacture supplies easy to disassemble thermally insulating shipping containers with RFID tags thereby allowing the forwarder to track the shipment while en route thereby producing a useful concrete and tangible result.

Forwarders to provide easy to disassemble thermally insulating shipping containers to their clients free of charge in exchange for retaining the financial benefit of weight savings, while giving their clients: (1) improved convenience, (2) cost of not having to buy containers, (3) eliminating ISPM-15 issues, (4) improving cargo safety, (5) improving human safety, (6) controlling the temperature of the cargo in the container and (7) gaining greater contracted cargo volume from clients.

Manufacturer production facilities are: (1) remarkably portable and inexpensive, (2) easily deployed anywhere, and (3) able to produce up to 2,500 easy to disassemble thermally insulating shipping containers per month. Factories can be readily placed in forwarders' market regions to service their local clients. No other competitive container production can match this scalability.

Each forwarder can secure exclusive "Agency" rights for a port or market region and pre-sell the full monthly production allocation of 2,500 containers (per manufacturer machine) by consigning them free of charge to strategic clients in exchange for cargo lift volume contracts. When the first allocation is gone, pre-sale of a second unit can begin until the major market clients are fully sold on a first-option basis. This strategy removes all risks from the program rollout. Clients are selected based on optimum profiles for cargo destinations, freight costs, type of cargo, size and importance of client and overall value of service the program provides to forwarder and client.

Revenues to forwarder are calculated on a cargo weight savings basis of 200 pounds per container and container costs are paid to manufacturer from those savings, leaving the cash balance to the forwarder. At $1 per pound, each container can yield $100 cash profit ($125,000 per month) to the forwarder. The forwarder can have no cash risk, as manufacturer is paid $60 per container from the saving stream (following collection of client's invoices) and the remainder is held by the forwarder. The only investment of the forwarder is the cost of sales efforts to pre-sell the cargo region.

In an embodiment of the invention, an easy to disassemble shipping container consisting of a base with two or more legs, a top panel and four walls. Wherein one or more of the base, the top panel and the four walls comprises a core, substantially surrounded by one or more thermoplastic sheets and one or more fasteners for fastening one or more of the base, the top panel and the four walls to one or more of the base, the top panel and the four walls.

In an embodiment of the invention, the net weight of the shipping container is between a lower limit of approximately 22 kg (50 lb) and an upper limit of approximately 90 kg (200 lb).

In an embodiment of the invention, a method of shipping products comprising loading the temperature sensitive products on a base with two or more legs, including a core and substantially surrounded by one or more thermoplastic sheets. Assembling four walls around the base, wherein the walls extend above the height of the products on the base. Wherein the four walls are made of lightweight material including a core and substantially surrounded by one or more thermoplastic sheets. Placing a top panel on top of the four walls, wherein the top panel is made of lightweight material including a core and substantially surrounded by one or more thermoplastic sheets. Fastening the base to one or more walls and the top panel to one or more walls. Wherein one or more of the base, the top panel and the four walls further comprise a strengthening material selected from the group consisting of a mesh, a perforated sheet and a barrier embedded in the core. Wherein the total weight of the base, the top panel and the four walls is between a lower limit of approximately 22 kg (50 lb) and an upper limit of approximately 90 kg (200 lb).

What is claimed is:

1. A selectively assembled and disassembled shipping container comprising:

a pallet, a top panel and a plurality of walls;

wherein one or more of the pallet, the top panel and the plurality of walls includes a core made from at least an expanded polymer and one or more thermoplastic sheets substantially surrounding the core, wherein the thermoplastic sheets are made of at least a high impact polymer;

wherein two or more of the walls are permanently interconnected and include grooves at the lower portion of the walls that are mateable with corresponding protrusions extending from said pallet so that the walls and said pallet are selectively engaged together to resist separation from each other; and wherein the top panel and the plurality of walls are separable from the pallet so that the pallet is loadable and/or movable independently from the top and the plurality of walls.

2. The container as outlined in claim 1, wherein the expanded polymer is selected from the group consisting of one or more of expanded polystyrene, a blend of polyphenylene ether and polystyrene impregnated with pentane, a blend of polyphenylene ether and polystyrene impregnated with pentane or polyethylene, and polypropylene.

3. The container as outlined in claim 1, wherein the high impact polymer is selected from the group consisting of one or more of high impact polystyrene, polypropylene, polypropylene composite, polycarbonate, low density polyethylene, high density polyethylene, polypropylene, acrylonitrile butadiene styrene and polyphony ether alloyed with high impact polystyrene.

4. The container as outlined in claim 1, wherein the core of one or more of the pallet, the top panel and the plurality of walls includes a strengthening material selected from the group consisting of a mesh, a perforated sheet and a barrier embedded in the core.

5. The container as outlined in claim 4, wherein the strengthening material is made from a material selected from the group consisting of metal, carbon fiber, Kevlar and Formica.

6. The container as outlined in claim 4, wherein one or more of the pallet, the top panel and the plurality of walls are one or both of puncture proof and tamper-proof.

7. The container as outlined in claim 1, wherein the net weight of the shipping container is between:

a lower limit of approximately 22 kg (50 lb); and an upper limit of approximately 90 kg (200 lb).

8. The container of claim 1, wherein:

two or more of the pallet, the top panel and the plurality of walls are connected by a living hinge.

9. The container as outlined in claim 1, further comprising:

one or more fasteners for fastening one or more of the pallet, the top panel and the plurality of walls to one or more of the pallet, the top panel and the plurality of walls.

10. The container as outlined in claim 9, wherein the fasteners are detachable from the container.

11. The container as outlined in claim 1, further comprising a Radio Frequency IDentification (RFID) tag affixed on or embedded in one or more of the pallet, the top panel and the plurality of walls.

12. The container as outlined in claim 11, wherein the RFID tag is embedded in the core of one or more of the pallet, the top panel and the plurality of walls.

13. The container as outlined in claim 11, further comprising:

a processor, a global satellite positioning system (GPS) and a cellular modem embedded in one or more of the pallet, the top panel and the plurality of walls;

wherein the cellular modem and the GPS are linked with the processor;

wherein the cellular modem is in communication with a base station;

wherein the processor can transmit to the base station one or more parameters selected from the group consisting of RFID code, shipment location, shipment information, shipment condition, shipment container condition and time stamp.

14. The container as outlined in claim 1, further comprising:

a RFID reader embedded in one or more of the pallet, the top panel and the plurality of walls;

wherein the RFID reader is able to read one or more RFID tags in the vicinity;

wherein the RFID reader can transmit to a base station one or more parameters selected from the group consisting of one or more RFID tag location, one or more RFID tag identification code, shipment information, shipment condition, shipment container condition and time stamp.

15. The container as outlined in claim 1, further comprising two or more legs extending from the pallet and one or more detachable runners, wherein the runners are longitudinally affixed to two or more of the two or more legs.

16. The container as outlined in claim 1, further comprising a liner; wherein the liner can be adapted to hold one or more liquids during one or more of shipment, transport and storage.

17. The container as outlined in claim 1, further comprising a frame into which one or more of the pallet, the top panel and the plurality of walls are inserted.

18. The container as outlined in claim 1, further comprising a shipping container bag to enclose the container, wherein the shipping bag has two or more characteristics selected from the group consisting of dust proof, weather proof, UV light reflective, and hoistable with an empty container for storage, and fire resistant.

19. A selectively assembled and disassembled shipping container comprising:

a pallet, a top panel and a plurality of walls;

wherein one or more of the pallet, the top panel and the plurality of walls includes a core made of at least an expanded polymer and one or more thermoplastic sheets substantially surrounding the core;

wherein the thermoplastic sheets are made of a material having an average density substantially greater than the density of the expanded polymer; and wherein at least two or more of the top panel and the plurality of walls are connected by a living hinge, wherein the living hinge is formed by one or both of the core and the one or more thermoplastic sheets;

wherein the shipping container includes a groove and a complementary protrusion mateable with said groove so that said two or more connected walls and said pallet are selectively engaged together to resist separation from each other; and wherein the top panel and the plurality of walls are separable from the pallet so that the pallet is loadable and/or movable independently from the top and the plurality of walls.

20. The container of claim 19 wherein:

each of the top panel and the plurality of walls is connected with at least one other of the top panel and the plurality of walls by a living hinge;

the plurality of walls are mateable with the pallet; and one or more fasteners for fastening the pallet to one or more of the plurality of walls.

21. The container of claim 19 wherein:

each of the pallet, the top panel and the plurality of walls is connected with at least one other of the pallet, the top panel and the plurality of walls by a living hinge.

22. The container as outlined in claim 19, wherein the expanded polymer is selected from the group consisting of one or more of expanded polystyrene, a blend of polyphenylene ether and polystyrene impregnated with pentane, a blend of polyphenylene ether and polystyrene impregnated with pentane or polyethylene, and polypropylene; and the thermoplastic sheets are made of a material selected from the group consisting of one or more of high impact polystyrene, polypropylene, polypropylene composite, polycarbonate, low density polyethylene, high density polyethylene, polypropylene, acrylonitrile butadiene styrene and polyphony ether alloyed with high impact polystyrene.

23. The container as outlined in claim 19, wherein the core of one or more of the pallet, the top panel and the plurality of walls includes a strengthening material selected from the group consisting of a mesh, a perforated sheet and a barrier embedded in the core; and the strengthening material is made from a material selected from the group consisting of metal, carbon fiber, Kevlar and Formica.

24. A selectively assembled and disassembled shipping container comprising:

a pallet with two or more legs, a top panel and a plurality of walls;

wherein one or more of the pallet, the top panel and the plurality of walls includes:

(a) a core, wherein the core includes a first material including an expanded polymer;

(b) substantially surrounded by one or more thermoplastic sheets, wherein the thermoplastic sheets are made of a second material, wherein the density of the second material is substantially greater than the density of the first material; and (c) one or more fasteners for fastening one or more of the top panel and the plurality of walls to one or more of the top panel and the plurality of walls; and wherein two or more of the walls are permanently interconnected and include grooves at the lower portion of the walls that are mateable with corresponding protrusions extending from said pallet so that the walls and said pallet selectively engage together to resist separation from each other;

wherein the top panel and the plurality of walls are separable from the pallet so that the pallet is loadable and/or movable independently from the top and the plurality of walls.

25. The container as outlined in claim 1, wherein the one or more thermoplastic sheets are chemically bonded to the core.

* * * * *